US007441554B2

(12) United States Patent
Nakagawa et al.

(10) Patent No.: US 7,441,554 B2
(45) Date of Patent: Oct. 28, 2008

(54) ENGINE CONTROLLER

(75) Inventors: Shinji Nakagawa, Hitachinaka (JP); Youichi Iihoshi, Tsuchiura (JP); Yoshikuni Kurashima, Mito (JP); Toshio Hori, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 11/738,955

(22) Filed: Apr. 23, 2007

(65) Prior Publication Data

US 2007/0186914 A1 Aug. 16, 2007

Related U.S. Application Data

(63) Continuation of application No. 11/019,552, filed on Dec. 23, 2004, now Pat. No. 7,225,800.

(30) Foreign Application Priority Data

Dec. 26, 2003 (JP) ..... 2003-435413

(51) Int. Cl.
*F02D 41/30* (2006.01)

(52) U.S. Cl. ..... 123/673; 123/696; 701/109; 73/114.72

(58) Field of Classification Search ..... 123/673, 123/688, 690, 696; 701/109, 114, 103; 73/117.3, 73/114.71, 114.72, 114.73
See application file for complete search history.

(56) References Cited

U.S. PATENT DOCUMENTS

| | | | | |
|---|---|---|---|---|
| 6,470,868 | B2 * | 10/2002 | Nakagawa et al. | 123/673 |
| 6,481,273 | B2 | 11/2002 | Maloney | |
| 6,550,466 | B1 | 4/2003 | Behr et al. | |
| 6,961,653 | B2 | 11/2005 | Maki | |
| 7,021,300 | B2 | 4/2006 | Maki et al. | |

FOREIGN PATENT DOCUMENTS

| | | | |
|---|---|---|---|
| JP | 7-247886 | A | 9/1995 |
| JP | 2002-61537 | A | 2/2002 |
| JP | 2003-270193 | A | 9/2003 |
| JP | 2005-194891 | | 7/2005 |

* cited by examiner

*Primary Examiner*—Hai H Huynh
(74) *Attorney, Agent, or Firm*—Crowell & Moring LLP

(57) ABSTRACT

The invention provides an engine controller, which can determine a deterioration mode (gain deterioration or response deterioration) of an air/fuel (A/F) ratio sensor, can detect a degree of the deterioration with high accuracy, and can optimize A/F ratio feedback control in accordance with the diagnosis result. The controller includes a unit for computing frequency response characteristics in a range from an A/F ratio adjusting unit to the A/F ratio sensor, and it diagnoses the A/F ratio sensor based on a gain characteristic and a response characteristic given by the computed frequency response characteristics. In accordance with the diagnosis result, parameters (P- and I-component gains) used in A/F ratio feedback control (PI control) are optimized.

7 Claims, 42 Drawing Sheets

ENGINE CONTROLLER

BACKGROUND OF THE INVENTION

1. Field of the Invention

The present invention relates to an engine controller including an air/fuel (A/F) ratio adjusting unit, such as a throttle valve and a fuel injector valve, for adjusting an A/F ratio of an air-fuel mixture subjected to combustion, and an A/F ratio detecting unit, such as a linear A/F ratio sensor, disposed in an exhaust passage. More particularly, the present invention relates to an engine controller capable of diagnosing, for example, whether the A/F ratio detecting unit has deteriorated or not, and optimizing A/F ratio control in accordance with the diagnosis result.

2. Description of the Related Art

Recently, controls on auto-emission have been tightened. To clean HC, CO and NOx exhausted from an engine, it has become general to dispose, in an exhaust passage, a three-way catalyst and, upstream of the catalyst, a linear A/F ratio sensor (hereinafter referred to as an "A/F sensor") producing a linear output (signal) with respect to an A/F ratio so that the catalyst develops an action with high efficiency and A/F ratio feedback control is performed with high robustness. Meanwhile, self-diagnosis controls have also been introduced in North America, Europe, Japan, etc. Correspondingly, there arises a demand for increasing diagnosis accuracy of the A/F sensor, i.e., for identifying a deterioration mode (gain deterioration or response deterioration) of the A/F sensor and detecting a degree of the deterioration with high accuracy. Under such a background, proposals have hitherto been made on a method (diagnosis method) for detecting the deterioration of the A/F sensor with high accuracy, and a method for optimizing parameters in the A/F ratio feedback control in accordance with the diagnosis result, to thereby maintain the performance of an exhaust cleaning system.

SUMMARY OF THE INVENTION

For example, JP-A-2003-270193 (pages 1-22 and FIGS. 1-12) proposes a method comprising the steps of taking correlation between a time differentiation value of an A/F sensor output in an actual state and a time differentiation value of the A/F sensor output in a normal state, and determining the A/F sensor as being abnormal when the correlation value is below a predetermined value. With this proposed method, a change in response of the A/F sensor can be detected, but a separate diagnosis must be performed to detect the gain deterioration of the A/F sensor. Further, the diagnosis result is not reflected on the control. In other words, no consideration is paid to the above-mentioned point of maintaining the performance of the exhaust cleaning system in match with the performance change (deterioration) of the A/F sensor.

Also, JP-A-7-247886 (pages 1-15 and FIGS. 1-13) proposes a technique that an adaptive controller provided with a step-by-step parameter adjusting mechanism is disposed in an A/F ratio feedback control system, and a target A/F ratio and an A/F sensor output are applied to the adaptive controller, to thereby decide an A/F-ratio feedback correction amount in an adaptive manner. With this proposed technique, because the A/F-ratio feedback correction amount is adaptively decided depending on the characteristic change (deterioration) of the A/F sensor, the performance of the exhaust cleaning system can be maintained in match with the performance change (deterioration) of the A/F sensor. However, it is difficult to specify a deterioration mode (gain deterioration or response deterioration) of the A/F sensor and to exactly detect a degree of the deterioration. Hence, there still remains a problem from the viewpoint of accuracy in diagnosis of the A/F sensor.

In addition, JP-A-2002-61537 (pages 1-13 and FIGS. 1-22) proposes a method comprising the steps of setting an A/F ratio to different values per cylinder so that the A/F ratio is caused to oscillate corresponding to 2 revolutions of an engine in a joined portion of individual exhaust passages (exhaust pipes), detecting a response deterioration of the A/F sensor only from the amplitude of the oscillation waveform, and adjusting parameters in A/F ratio feedback control in accordance with a deterioration state. However, the typical deterioration mode of the A/F sensor contains not only the response deterioration, but also the gain deterioration as described above. Because the amplitude of the A/F ratio oscillation is reduced in any of those two deterioration modes, the proposed method cannot specify the deterioration mode. Furthermore, as described later, optimum parameters in the A/F ratio feedback control differ between the case of gain deterioration and the case of response deterioration. For example, when the deterioration mode is erroneously detected as the response deterioration instead of the gain deterioration, control accuracy in the A/F ratio feedback control is rather reduced.

With the view of overcoming the above-mentioned problems in the related art, it is an object of the present invention to provide an engine controller which can diagnose an A/F ratio detecting unit, such as an A/F sensor, to precisely determine whether a deterioration mode is gain deterioration or response deterioration, which can detect a degree of the deterioration in a quantitative way, and which can optimize A/F ratio feedback control in accordance with the diagnosis result.

To achieve the above object, according to a first aspect of the present invention, there is provided an engine controller for controlling an air/fuel ratio, wherein the controller comprises a frequency response characteristic computing unit for computing, based on an air/fuel ratio detected by an air/fuel ratio detecting unit and an air/fuel ratio control signal outputted to an air/fuel ratio adjusting unit, a frequency response characteristic in a range from the air/fuel ratio adjusting unit to the air/fuel ratio detecting unit (see FIG. 1).

There is a transfer characteristic (delay element) in the range from the air/fuel ratio control signal supplied to a fuel injector valve, i.e., one example of the air/fuel ratio adjusting unit, to the air/fuel ratio detected by an air/fuel (A/F) sensor, i.e., one example of the air/fuel ratio detecting unit, disposed in an exhaust passage near an inlet of a three-way catalyst. The transfer characteristic is primarily attributable to (1) the evaporation rate of injected fuel is not 100% and a part of the injected fuel remains in the exhaust passage, (2) an engine operates with intermittent combustion, (3) exhaust (exhaust gas) suffers a diffusion reduction and takes a transport time from an exhaust valve to the A/F sensor, and (4) a transfer characteristic in the A/F sensor itself from a real air/fuel ratio to a sensor output. The first aspect of the present invention is featured in detecting the above transfer characteristic as a frequency response characteristic.

According to a second aspect of the present invention, in addition to the first aspect, the engine controller further comprises a diagnosis unit for diagnosing the air/fuel ratio detecting unit based on the frequency response characteristic computed by the frequency response characteristic computing unit (see FIG. 2).

Of the above primary factors affecting the transfer characteristic in the range from the air/fuel ratio control signal to the air/fuel ratio detected by the air/fuel ratio detecting unit, the factors (1) to (3) are hardly changed once engine operating status is decided. Therefore, when the transfer characteristic (delay element) in the range from the air/fuel ratio control signal to the detected air/fuel ratio is changed in a particular engine operating status, this can be regarded as a characteristic change depending on the factor (4). It is hence possible to diagnose, based on the frequency response characteristic, the performance of the air/fuel ratio detecting unit, i.e., whether the air/fuel ratio detecting unit has deteriorated or not, and a degree of the deterioration.

According to a third aspect of the present invention, in the above engine controller, the frequency response characteristic computing unit computes, as the frequency response characteristic, a gain characteristic and a phase characteristic (see FIG. 3).

Namely, the third aspect is featured in representing the frequency response characteristic as the gain characteristic and the phase characteristic with respect to an arbitrary frequency.

According to a fourth aspect of the present invention, in the above engine controller, when the gain characteristic is changed over a predetermined value and the phase characteristic is not changed over a predetermined value, the diagnosis unit determines that the gain characteristic of the air/fuel ratio detecting unit has changed, and when the gain characteristic is changed over the predetermined value and the phase characteristic is changed over the predetermined value, the diagnosis unit determines that the response characteristic of the air/fuel ratio detecting unit has changed (see FIG. 4).

Assume here that the transfer characteristic in the range from the real air/fuel ratio to the output of the air/fuel ratio detecting unit (A/F sensor) when the A/F sensor is normal is expressed in terms of a primary delay as shown in the following formula (1):

$$G0(s)=K0\cdot\{1/(1+\tau 0\cdot s)\} \quad (1)$$

In the above formula (1), K0 represents the gain characteristic and τO represents the response characteristic. Therefore, when the gain characteristic of the A/F sensor is changed, the transfer characteristic in the range from the real air/fuel ratio to the output of the A/F sensor is expressed by the following formula (2):

$$G1(s)=K1\cdot\{1/(1+\tau 0\cdot s)\} \quad (2)$$

FIG. 21 shows the frequency response characteristics (gain characteristic and phase characteristic) expressed by the formulae (1) and (2). In this case, of the frequency response characteristics, only the gain characteristic is changed and the phase characteristic is not changed. On the other hand, when the response characteristic of the A/F sensor is changed, the transfer characteristic in the range from the real air/fuel ratio to the output of the A/F sensor is expressed by the following formula (3):

$$G2(s)=K0\cdot\{1/(1+\tau 1\cdot s)\} \quad (3)$$

FIG. 22 shows the frequency response characteristics (gain characteristic and phase characteristic) expressed by the formulae (1) and (3). In this case, of the frequency response characteristics, both the gain characteristic and the phase characteristic are changed. Based on the above-described consideration, according to the fourth aspect of the present invention, when the gain characteristic is changed, but the phase characteristic is not changed, the diagnosis unit determines that the gain characteristic of the A/F sensor has changed. Also, when both the gain characteristic and the phase characteristic are changed, the diagnosis unit determines that the response characteristic of the A/F sensor has changed.

According to a fifth aspect of the present invention, in the above engine controller, the diagnosis unit comprises a frequency-response-characteristic reference value computing unit for computing a gain characteristic reference value and a phase characteristic reference value, and a gain and phase comparing unit for comparing the gain characteristic with the gain characteristic reference value and comparing the phase characteristic with the phase characteristic reference value, and the diagnosis unit diagnoses the air/fuel ratio detecting unit based on a comparison result of the gain and phase comparing unit (see FIG. 5).

For example, the gain characteristic and the phase characteristic in the normal state of the air/fuel ratio detecting unit (A/F sensor) are set respectively as the gain characteristic reference value and the phase characteristic reference value. Then, as shown in FIGS. 20 and 21, a performance change (deterioration) of the A/F sensor is detected by comparing the gain characteristic reference value and the phase characteristic reference value respectively with the gain characteristic and the phase characteristic which are computed (detected) by the frequency response characteristic computing unit.

According to a sixth aspect of the present invention, in the above engine controller, the gain and phase comparing unit determines a Δ gain as a difference between the gain characteristic reference value and the gain characteristic and a Δ phase as a difference between the phase characteristic reference value and the phase characteristic, and when an absolute value of the Δ gain is over a predetermined value and an absolute value of the Δ phase is below a predetermined value, the diagnosis unit determines that the gain characteristic of the air/fuel ratio detecting unit has changed, while when the absolute value of the Δ gain is over the predetermined value and the absolute value of the Δ phase is over the predetermined value, the diagnosis unit determines that the response characteristic of the air/fuel ratio detecting unit has changed (see FIG. 6).

Namely, the sixth aspect defines the diagnosis process in more detail than the fifth aspect.

According to a seventh aspect of the present invention, in the above engine controller, the frequency-response-characteristic reference value computing unit computes the gain characteristic reference value and the phase characteristic reference value based on operating status of the engine.

The factors (1), (2) and (3) affecting the transfer characteristic (delay element) in the range from the air/fuel ratio control signal to the detected air/fuel ratio are hardly changed if the engine operating status is constant. However, the factors (1), (2) and (3) are changed depending on variations of the engine operating status. In consideration of those variations, the frequency response characteristic reference values, i.e., the reference values used in the comparisons, are set depending on the engine operating status.

According to an eighth aspect of the present invention, in the above engine controller, the frequency-response-characteristic reference value computing unit computes the gain characteristic reference value and the phase characteristic reference value based on at least engine revolutions per minute (RPM) and an air intake (see FIG. 7).

This eighth aspect is on the basis of the finding that the factors (1), (2) and (3) affecting the transfer characteristic (delay element) in the range from the air/fuel ratio control signal to the detected air/fuel ratio are decided primarily depending on the engine RPM and the air intake (or engine torque).

According to a ninth aspect of the present invention, the above engine controller further comprises an air/fuel ratio control unit for setting, based on the detected air/fuel ratio, the air/fuel ratio control signal supplied to the air/fuel ratio adjusting unit (see FIG. 8).

Namely, the A/F ratio feedback control is executed using the signal obtained from the air/fuel ratio detecting unit (i.e., the A/F sensor output).

According to a tenth aspect of the present invention, in the above engine controller, the air/fuel ratio control unit comprises a target air/fuel ratio computing unit for computing a target air/fuel ratio, and an air/fuel ratio correction amount computing unit for computing an air/fuel ratio correction amount based on a difference between the target air/fuel ratio and the detected air/fuel ratio (see FIG. 9).

This tenth aspect defines the configuration of the air/fuel ratio control unit in more detail.

According to an eleventh aspect of the present invention, in the above engine controller, the air/fuel ratio adjusting unit is a fuel supply adjusting unit including a fuel injector valve, and/or an air intake adjusting unit including a throttle valve (see FIG. 10).

This eleventh aspect defines the air/fuel ratio adjusting unit in more detail from the practical point of view. One example of the fuel supply adjusting unit is a fuel injector valve (injector). The mount position of the injector is not limited to an intake port (i.e., port injection), but it may be disposed, for example, inside a combustion chamber (i.e., in-cylinder injection). One example of the air intake adjusting unit is a throttle valve. As an alternative, the air intake can also be adjusted by operating an intake valve (e.g., the opening/closing timing or lift amount thereof), an ISC valve, an EGR valve, etc.

According to a twelfth aspect of the present invention, in the above engine controller, the air/fuel ratio control unit includes a per-cylinder air/fuel ratio correction amount computing unit for computing an air/fuel ratio correction amount per cylinder, and the frequency response characteristic computing unit includes a frequency component computing unit for computing a component of a signal obtained from the air/fuel ratio detecting unit at an N/2-order (N=1, 2, 3, 4, . . . ) frequency of the engine revolutions (see FIG. 11).

The air/fuel ratio is corrected per cylinder to vary the air/fuel ratio among the cylinders, thereby causing the air/fuel ratio to oscillate corresponding to 2 revolutions of the engine in a joining portion of individual exhaust passages (exhaust pipes). Then, the frequency response characteristics (i.e., the gain characteristic and the phase characteristic) are computed by extracting N/2-order (N=1, 2, 3, 4, . . . ) components of the oscillation waveform, which correspond to integer times a frequency of two revolutions of the engine.

According to a thirteenth aspect of the present invention, in the above engine controller, the air/fuel ratio control unit comprises a unit for computing a correction amount to evenly correct the air/fuel ratio for all cylinders, and a unit for computing a correction amount to correct the air/fuel ratio for a particular cylinder, and the frequency response characteristic computing unit includes a frequency component computing unit for computing a component of a signal obtained from the air/fuel ratio detecting unit at an N/2-order (N=1, 2, 3, 4, . . . ) frequency of the engine revolutions (see FIG. 12).

When the controller has the function of executing conventional air/fuel ratio control (forward control or a backward control) for evenly correcting the air/fuel ratio for all the cylinders, the air/fuel ratio can be caused to oscillate corresponding to 2 revolutions of the engine in the joining portion of the individual exhaust passages (exhaust pipes) just by varying the air/fuel ratio for the particular cylinder from the air/fuel ratio for the other cylinders. The frequency response characteristics (i.e., the gain characteristic and the phase characteristic) are computed by extracting N/2-order (N=1, 2, 3, 4, . . . ) components of the oscillation waveform, which correspond to integer times a frequency of two revolutions of the engine.

According to a fourteenth aspect of the present invention, in the above engine controller, the frequency response characteristic computing unit includes a frequency component computing unit for computing a component of the signal obtained from the air/fuel ratio detecting unit at least at a 1/2-order frequency of the engine revolutions.

This fourteenth aspect defines the N/2-order components of the oscillation waveform corresponding to integer times the frequency of two revolutions of the engine in more detail than the twelfth and thirteenth aspects such that it employs the component at the 1/2-order frequency of the engine revolutions. This feature is on the basis of the finding that, when detecting the frequency response characteristic, it is optimum to employ the component at the 1/2-order frequency of the engine revolutions engine from the viewpoint of S/N ratio.

According to a fifteenth aspect of the present invention, in the engine controller according to the twelfth or thirteenth aspect, the diagnosis unit comprises a frequency-response-characteristic reference value computing unit for computing a gain characteristic reference value and a phase characteristic reference value, and a gain and phase comparing unit for comparing the gain characteristic computed by the frequency component computing unit with the gain characteristic reference value and comparing the phase characteristic computed by the frequency component computing unit with the phase characteristic reference value, and the diagnosis unit diagnoses the air/fuel ratio detecting unit based on a comparison result of the gain and phase comparing unit (see FIG. 13).

According to a sixteenth aspect of the present invention, in addition to the above aspect, the engine controller further comprises a parameter correction amount computing unit for computing a correction amount of an air/fuel ratio control parameter, which is used in the air/fuel ratio control unit, based on diagnosis results for the air/fuel ratio detecting unit by the diagnosis unit (see FIG. 14).

Generally, a parameter in the air/fuel ratio feedback (F/B) control is optimized on the premise that the air/fuel ratio detecting unit (A/F sensor) is in the normal state. When the characteristic of the A/F sensor changes, the transfer characteristic (delay element) in the range from the air/fuel ratio control signal to the detected air/fuel ratio is also changed, and therefore so is an optimum parameter in the air/fuel ratio feedback control (e.g., PI or PID control) (see FIGS. 23 and 24). In view of such a point, when a characteristic change of the A/F sensor is detected, the parameter in the air/fuel ratio feedback control is optimized in accordance with the detected information.

According to a seventeenth aspect of the present invention, in the above engine controller, the air/fuel ratio control unit executes PID control based on a difference between the target air/fuel ratio and the detected air/fuel ratio so that the air/fuel ratio of an air-fuel mixture is equal to the target air/fuel ratio, and the parameter correction amount computing unit computes a correction amount of at least one of P-, I- and D-component gains as parameters in the PID control (see FIG. 15).

This seventeenth aspect defines the parameter in the air/fuel ratio feedback control in more detail than the sixteenth aspect. When the air/fuel ratio feedback control is executed as the PID control and a characteristic change of the A/F sensor is detected, at least one of the P-, I- and D-component gains as parameters in the PID control is optimized in accordance with the detected information. FIGS. 23 and 24 show optimum P- and I-component gains in the PI control when the gain characteristic and the response characteristic are changed, respectively.

According to an eighteenth aspect of the present invention, in the engine controller according to the seventeenth aspect, the air/fuel ratio correction amount computing unit for all cylinders corrects P-, I- and D-components in accordance with the correction amount of at least one of the P-, I- and D-component gains as parameters in the PID control which are computed by the parameter correction amount computing unit (see FIG. 16).

According to a nineteenth aspect of the present invention, in the above engine controller, the parameter correction amount computing unit computes the correction amount of at least one of the P-, I- and D-component gains as parameters in the PID control based on a gain deterioration degree and a response deterioration degree of the air/fuel ratio detecting unit, which are given as the diagnosis results of the diagnosis unit (see FIG. 17).

According to a twentieth aspect of the present invention, the above engine controller further comprises a detected-air/fuel-ratio correction amount computing unit for computing, in accordance with the diagnosis results for the air/fuel ratio detecting unit by the diagnosis unit, a correction amount of the detected air/fuel ratio correcting unit based on a first signal obtained from the air/fuel ratio detecting unit and a second signal computed from both the first signal and the correction amount of the detected air/fuel ratio, and a detected air/fuel ratio correcting unit for correcting the detected air/fuel ratio, which is represented by a signal inputted from the air/fuel ratio detecting unit to the air/fuel ratio control unit, in accordance with the correction amount of the detected air/fuel ratio computed by the detected-air/fuel-ratio correction amount computing unit (see FIG. 18).

With the engine controller of the present invention, it is possible to determine whether the deterioration mode of the air/fuel ratio detecting unit (A/F sensor) is gain deterioration or response deterioration, and to detect a degree of the deterioration in a quantitative manner. According to this twentieth aspect, therefore, the output of the A/F sensor (i.e., the detected air/fuel ratio) is subjected to reverse correction in accordance with the detected deterioration information so that the same output as that in the normal state is obtained. Then, the corrected output is used as the signal inputted to the air/fuel ratio control unit.

According to a twenty-first aspect of the present invention, in the above engine controller, the air/fuel ratio control unit executes air/fuel ratio feedback control based on a signal obtained from the air/fuel ratio detecting unit, and determines, during the air/fuel ratio feedback control, a rich correction period in which the air/fuel ratio of the air-fuel mixture is corrected to the rich side with respect to a stoichiometric air/fuel ratio and a lean correction period in which the air/fuel ratio of the air-fuel mixture is corrected to the lean side with respect to the stoichiometric air/fuel ratio, thereby determining rich/lean cycles from the rich correction period and the lean correction period, and the diagnosis unit diagnoses the air/fuel ratio detecting unit based on the rich/lean cycles and the gain characteristic and the response characteristic both computed by the frequency response characteristic computing unit (see FIG. 19).

In some types of the air/fuel ratio detecting unit (A/F sensor), the response time constant is large even in the normal state and the phase characteristic causes a phase delay from a relatively low frequency. Taking into account such a case, this twenty-first aspect is intended to detect the phase characteristic at a relatively low frequency by using the rich/lean cycles in the air/fuel ratio feedback control, to thereby increase the accuracy in detecting the phase characteristic. In other words, this twenty-first aspect is on the basis of the finding that the rich/lean cycles are prolonged as the response characteristic of the A/F sensor deteriorates.

According to a twenty-second aspect of the present invention, in addition to the above aspect, the engine controller further comprises a unit for diagnosing characteristics other than the air/fuel ratio detecting unit based on the frequency response characteristic computed by the frequency response characteristic computing unit, and a diagnosis target determining unit for determining based on operating status of the engine whether a diagnosis target is the air/fuel ratio detecting unit or other than the air/fuel ratio detecting unit (see FIG. 20).

According to a twenty-third aspect of the present invention, in the above engine controller, the characteristics other than the air/fuel ratio detecting unit include at least one of a characteristic of the air/fuel ratio adjusting unit, a characteristic of fuel, and a characteristic of combustion.

As mentioned above, the transfer characteristic in the range from the air/fuel ratio control signal supplied to a fuel injector valve, i.e., one example of the air/fuel ratio adjusting unit, to the air/fuel ratio detected by the air/fuel ratio detecting unit (A/F sensor) is primarily attributable to (1) the evaporation rate of injected fuel is not 100% and a part of the injected fuel remains in the exhaust passage, (2) the engine operates with intermittent combustion, (3) exhaust (exhaust gas) suffers a diffusion reduction and takes a transport time from the exhaust valve to the A/F sensor, and (4) a transfer characteristic in the A/F sensor itself from the real air/fuel ratio to the sensor output. While the factors (1) to (3) of the transfer characteristic are hardly changed once the engine operating status is decided, they may be changed in a particular condition. For example, if fuel nature changes, the factor (1) of the transfer characteristic is also changed. Because the fuel nature affects the factor (1) only in a relatively low-temperature region of the engine, it is determined that the fuel nature has changed, when the frequency response characteristic is changed on condition that the A/F sensor is normal and the engine cooling water temperature is below a predetermined value.

Furthermore, an automobile according to the present invention is featured in mounting an engine provided with the controller described above.

Thus, the engine controller according to the present invention can diagnose the A/F ratio detecting unit, such as the A/F sensor, to precisely determine whether the deterioration mode is gain deterioration or response deterioration, and can detect a degree of the deterioration in a quantitative way. It is hence possible to optimize the A/F ratio feedback control in accordance with the diagnosis result on the A/F ratio detecting unit, and to realize a exhaust cleaning system that is robust against the characteristic change of the A/F ratio detecting unit.

DESCRIPTION OF THE PREFERRED EMBODIMENTS

Embodiments of the present invention will be described below with reference to the drawings.

First Embodiment

Figure 25:
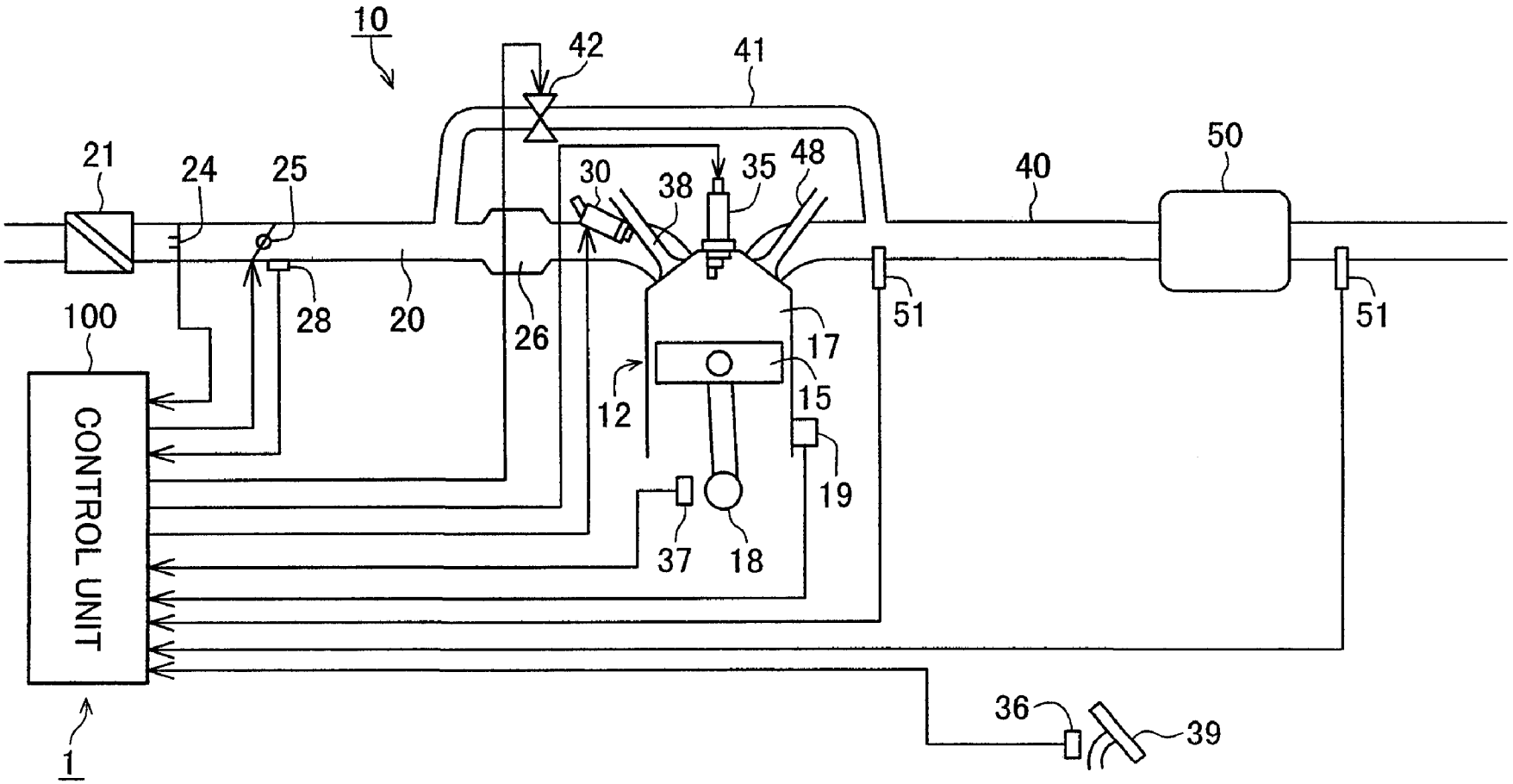
FIG. 25 is a schematic view showing the first embodiment of the engine controller according to the present invention along with an engine to which the first embodiment is applied.

FIG. 25 is a schematic view showing a first embodiment of an engine controller according to the present invention along with a vehicle-loaded engine to which the first embodiment is applied.

Figure 27:
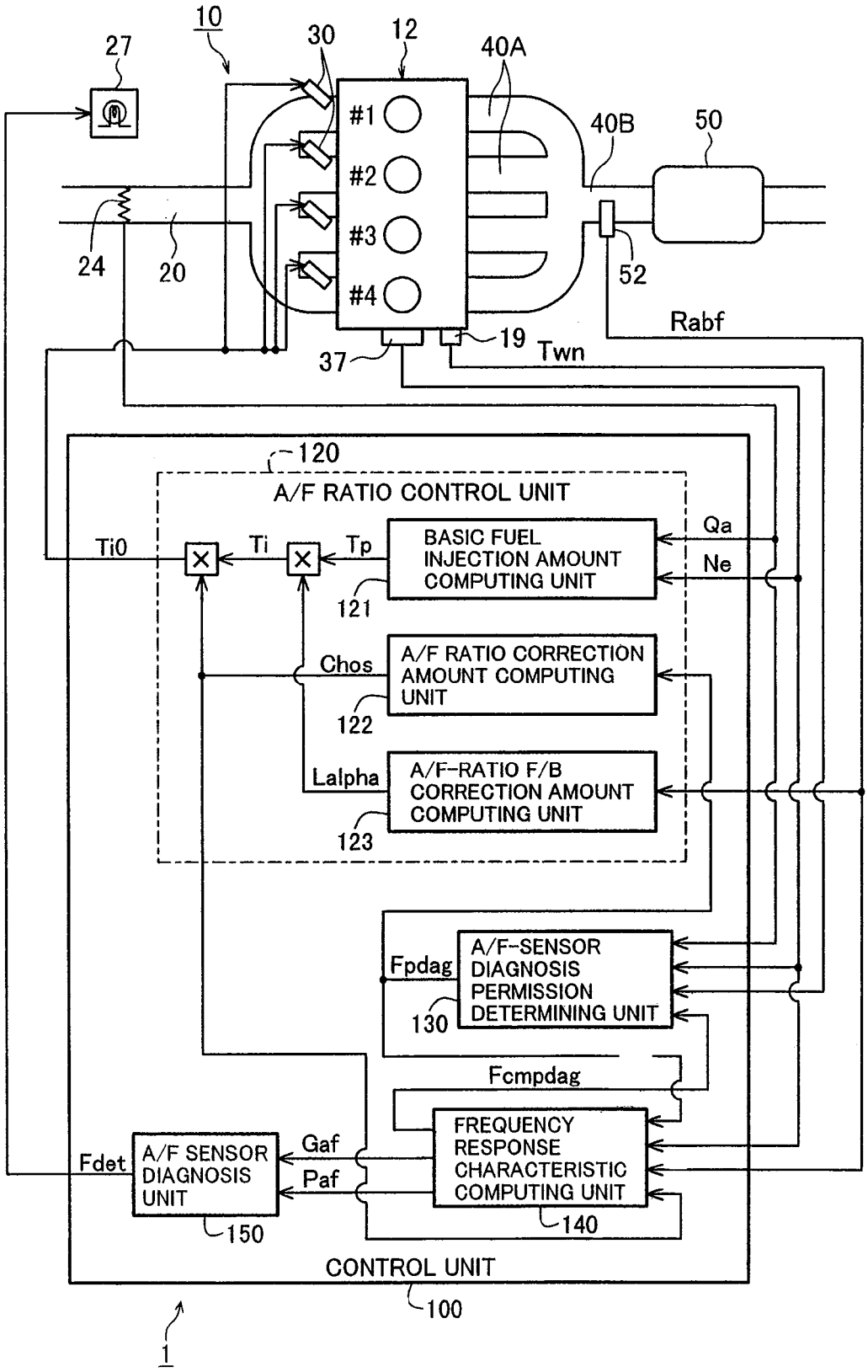
FIG. 27 is a block diagram of a control system in the first embodiment.

An engine 10 shown in FIG. 25 is a multi-cylinder engine having, for example, four cylinders #1, #2, #3 and #4 (see FIG. 27). The engine 10 comprises a cylinder block 12 and a piston 15 slidably fitted to each of the cylinders #1, #2, #3 and #4. A combustion chamber 17 is defined above the piston 15. An ignition plug 35 is disposed so as to project into the combustion chamber 17.

Air to be supplied for combustion of fuel is taken in through an air cleaner 21 disposed at an entrance end of an intake passage 20, and then enters a collector 26 after passing an airflow sensor 24 and an electrically-controlled throttle valve 25. From the collector 26, the air is sucked into the combustion chamber 17 for each of the cylinders #1, #2, #3 and #4 through an intake valve 38 disposed at a downstream end (intake port) of the intake passage 20. Also, a fuel injector valve 30 is disposed so as to project into a downstream portion (branched passage portion) of the intake passage 20.

A mixture of the air sucked into the combustion chamber 17 and the fuel injected from the fuel injector valve 30 is ignited by the ignition plug 35 for explosion and combustion. Resulting combustion waste gas (exhaust gas) is exhausted from the combustion chamber 17 through an exhaust valve 48 to each of individual passages 40A (see FIG. 27) that constitute an upstream portion of an exhaust passage 40. From the individual passages 40A, the exhaust gas passes an exhaust joining portion 40B and enters a three-way catalyst 50 disposed in the exhaust passage 40 for cleaning. The cleaned gas is then exhausted to the exterior.

Further, an oxygen sensor 51 is disposed in the exhaust passage 40 downstream of the three-way catalyst 50, and an A/F sensor 52 is disposed in the exhaust joining portion 40B of the exhaust passage 40 upstream of the three-way catalyst 50.

The A/F sensor 52 has a linear output characteristic with respect to the concentration of oxygen contained in the exhaust gas. Because the relationship between the oxygen concentration and the A/F ratio in the exhaust gas is substantially linear, the A/F ratio in the exhaust joining portion 40B can be determined by using the A/F sensor 52 that detects the oxygen concentration. Also, based on a signal from the oxygen sensor 51, it is possible to determine the oxygen concentration downstream of the three-way catalyst 50, or whether the exhaust gas is rich or lean with respect to the stoichiometric A/F ratio.

A part of the exhaust gas leaving from the combustion chamber 17 to the exhaust passage 40 is introduced to the intake passage 20 through an EGR (Exhaust Gas Recirculation) passage 41, as required, for recirculation to the combustion chamber 17 of each cylinder through the branched passage portion of the intake passage 20. An EGR valve 42 for adjusting an EGR rate is disposed in the EGR passage 41.

An engine controller 1 of this embodiment includes a control unit 100 with a built-in microcomputer for executing various kinds of control in the engine 10.

Figure 26:
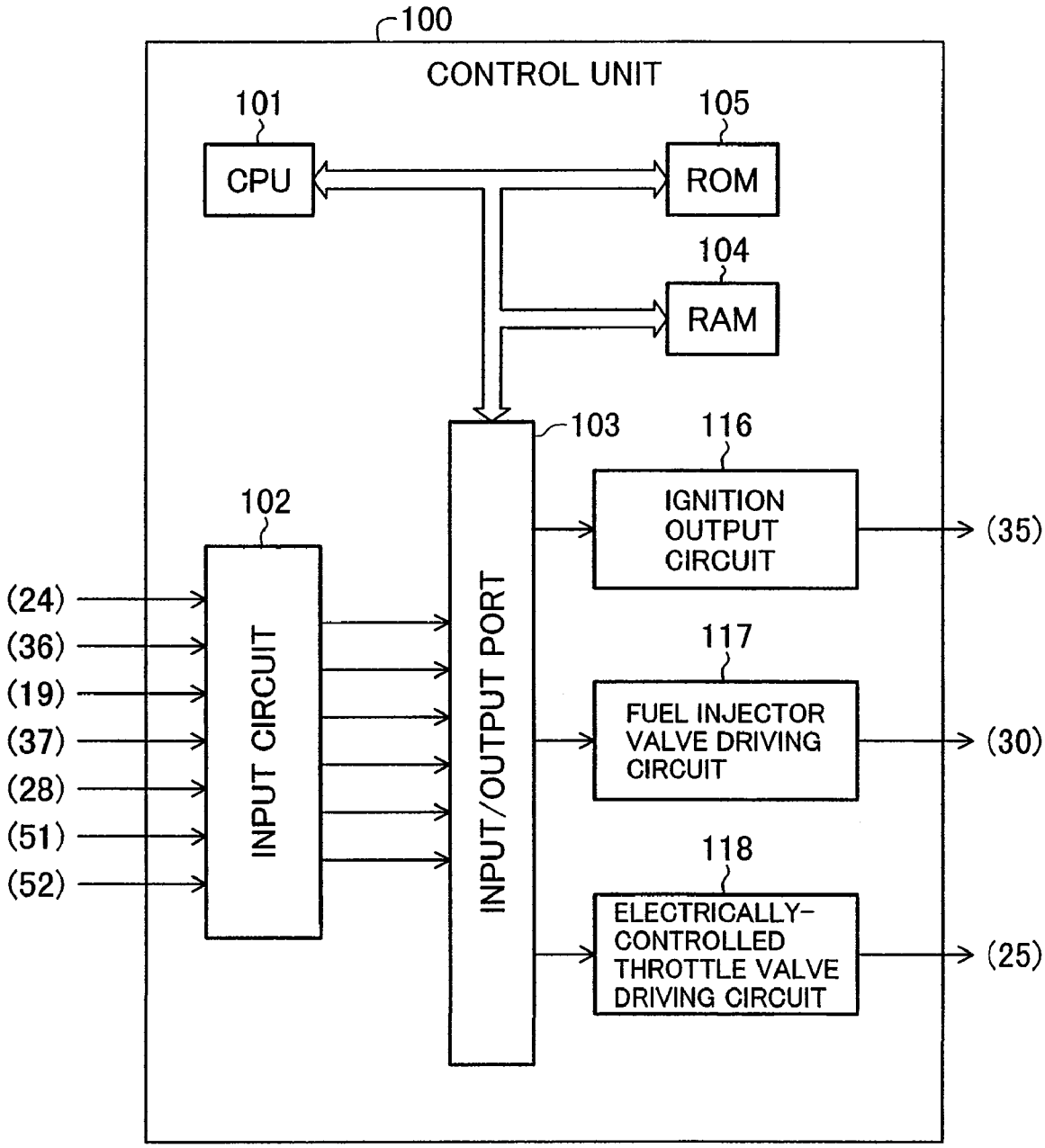
FIG. 26 is a block diagram showing an internal configuration of a control unit in the first embodiment.

As shown in FIG. 26, the control unit 100 basically comprises a CPU 101, an input circuit 102, an input/output port 103, a RAM 104, a ROM 105, and so on.

The control unit 100 receives, as input signals, a signal corresponding to the air intake and detected by an airflow sensor 24, a signal corresponding to the opening degree of the throttle valve 25 and detected by a throttle opening sensor 28, a signal representing revolutions (engine RPM (Revolutions Per Minute)) and phase of a crankshaft 18 and obtained from a crank angle sensor 37, a signal corresponding to the oxygen concentration in the exhaust gas and detected by the oxygen sensor 51 that is disposed in the exhaust passage 40 downstream of the three-way catalyst 50, a signal corresponding to the oxygen concentration (A/F ratio) and detected by the A/F sensor 52 that is disposed in the exhaust joining portion 40B of the exhaust passage 40 upstream of the three-way catalyst 50, a signal corresponding to the engine cooling water temperature and detected by a water temperature sensor 19 disposed on the cylinder block 12, a signal corresponding to the step-down amount of an accelerator pedal 39, which indicates a torque demanded by a driver, and detected by an accelerator stroke sensor 36, etc.

After receiving outputs of the above-mentioned sensors such as the A/F sensor 52, the oxygen sensor 51, the throttle opening sensor 28, the airflow sensor 24, the crank angle sensor 37, the water temperature sensor 19, and accelerator stroke sensor 36, the control unit 100 executes signal processing, such as noise removal, in the input circuit 102, and the processed signals are sent to the input/output port 103. Respective values received at the input/output port 103 are stored in the RAM 104 and are subjected to arithmetic and logical processing in the CPU 101. Control programs describing procedures of the arithmetic and logical processing are written in the ROM 105 beforehand. Values computed in accordance with the control programs and representing amounts by which respective actuators are to be operated are stored in the RAM 104 and then sent to the input/output port 103.

An operation signal for the ignition plug 35 is set as an ON/OFF signal such that it is turned on when a current is supplied to a primary side coil in an ignition output circuit 116, and turned off when a current is not supplied to the primary side coil. The ignition timing is given as a point in time at which the operation signal is turned from ON to OFF. The operation signal for the ignition plug 35 set at the input/output port 103 is amplified in the ignition output circuit 116 to a level of energy sufficient to start ignition and is then supplied to the ignition plug 35. Also, a driving signal for the fuel injector valve 30 (i.e., an A/F ratio control signal) is set as an ON/OFF signal such that it is turned on when the fuel injector valve 30 is opened, and turned off when the fuel injector valve 30 is closed. The A/F ratio control signal is amplified in a fuel injector valve driving circuit 117 to a level of energy sufficient to open the fuel injector valve 30 and is then supplied to the fuel injector valve 30. A driving signal for realizing a target opening degree of the electrically-controlled throttle valve 25 is sent to the throttle valve 25 through an electrically-controlled throttle valve driving circuit 118.

The control unit 100 computes the A/F ratio upstream of the three-way catalyst 50 based on the signal from the A/F sensor 52, and it also computes, based on the signal from the oxygen sensor 51, whether the exhaust gas is rich or lean with respect to the oxygen concentration or the stoichiometric A/F ratio downstream of the three-way catalyst 50. Furthermore, by using the outputs of both the sensors 51 and 52, the control unit 100 executes feedback control for sequentially correcting the fuel injection amount or the air intake so that the cleaning efficiency of the three-way catalyst 50 is optimized.

Practical processing procedures executed by the control unit 100 will be described below.

FIG. 27 is a functional block diagram of a control system in this embodiment. As shown in the functional block diagram, the control unit 100 comprises an A/F ratio control unit 120, an A/F-sensor diagnosis permission determining unit 130, a frequency response characteristic computing unit 140, and an A/F sensor diagnosis unit 150. The A/F ratio control unit 120 comprises a basic fuel injection amount computing unit 121, an A/F ratio correction amount computing unit 122, and an A/F-ratio feedback (F/B) correction amount computing unit 123.

Those processing units will be described in more detail one by one.

<Basic Fuel Injection Amount Computing Unit 121>

Figure 28:
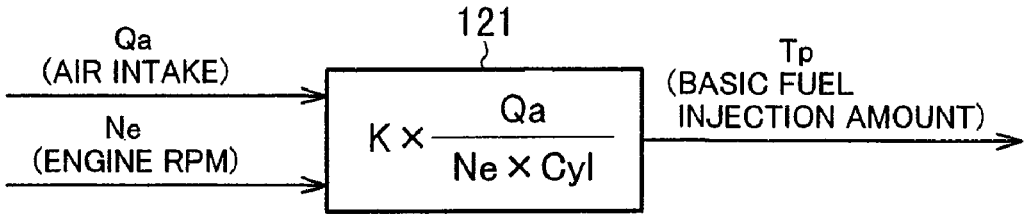
FIG. 28 is a block diagram for explaining a basic fuel injection amount computing unit in the first embodiment.

This computing unit 121 computes, based on an engine RPM Ne and an air intake Qa, a fuel injection amount at which a target torque and a target A/F ratio are realized at the same time in the operating status under arbitrary conditions. In practice, a basic fuel injection amount Tp is computed as shown in FIG. 28. In FIG. 28, K is a constant and set to a value for making an adjustment to always realize the stoichiometric A/F ratio with respect to the air intake. Also, "Cy1" represents the number (4 in this embodiment) of the cylinders in the engine 10.

<A/F-Ratio F/B Correction Amount Computing Unit 123>

Figure 29:
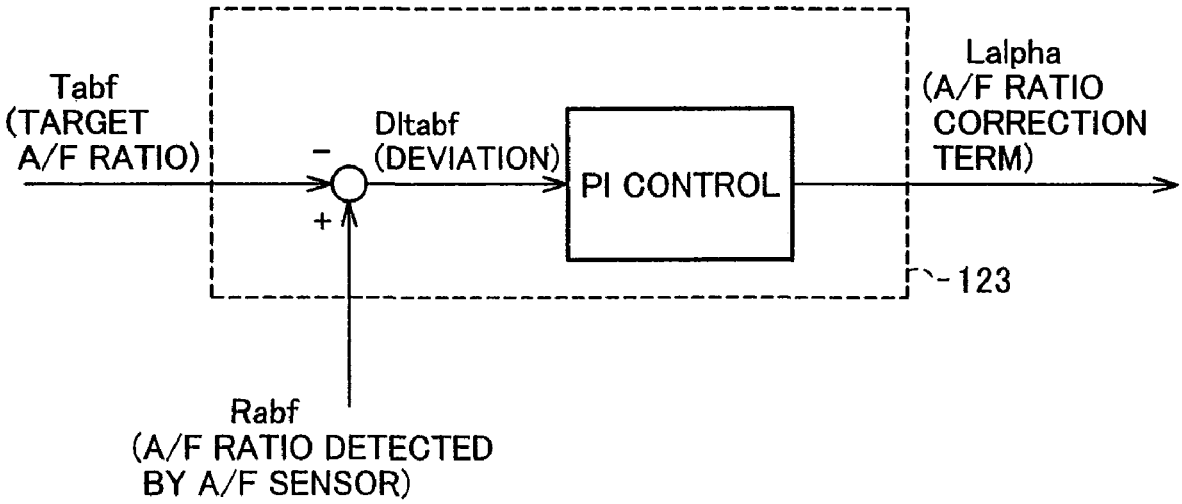
FIG. 29 is a block diagram for explaining an A/F-ratio F/B correction amount computing unit in the first embodiment.

This computing unit 123 computes, based on the A/F ratio detected by the A/F sensor 52, an A/F-ratio F/B correction amount so that an average A/F ratio in the exhaust joining portion 40B (i.e., at an inlet of the three-way catalyst 50) is equal to the target A/F ratio in the operating status under arbitrary conditions. In practice, as shown in FIG. 29, an A/F ratio correction term Lalpha is computed from a deviation Dltabf between a target A/F ratio Tabf and a real A/F ratio Rabf detected by the A/F sensor 52 in A/F ratio feedback control (PI control). The A/F ratio correction term Lalpha is multiplied by the basic fuel injection amount Tp.

<A/F-Sensor Diagnosis Permission Determining Unit 130>

Figure 30:
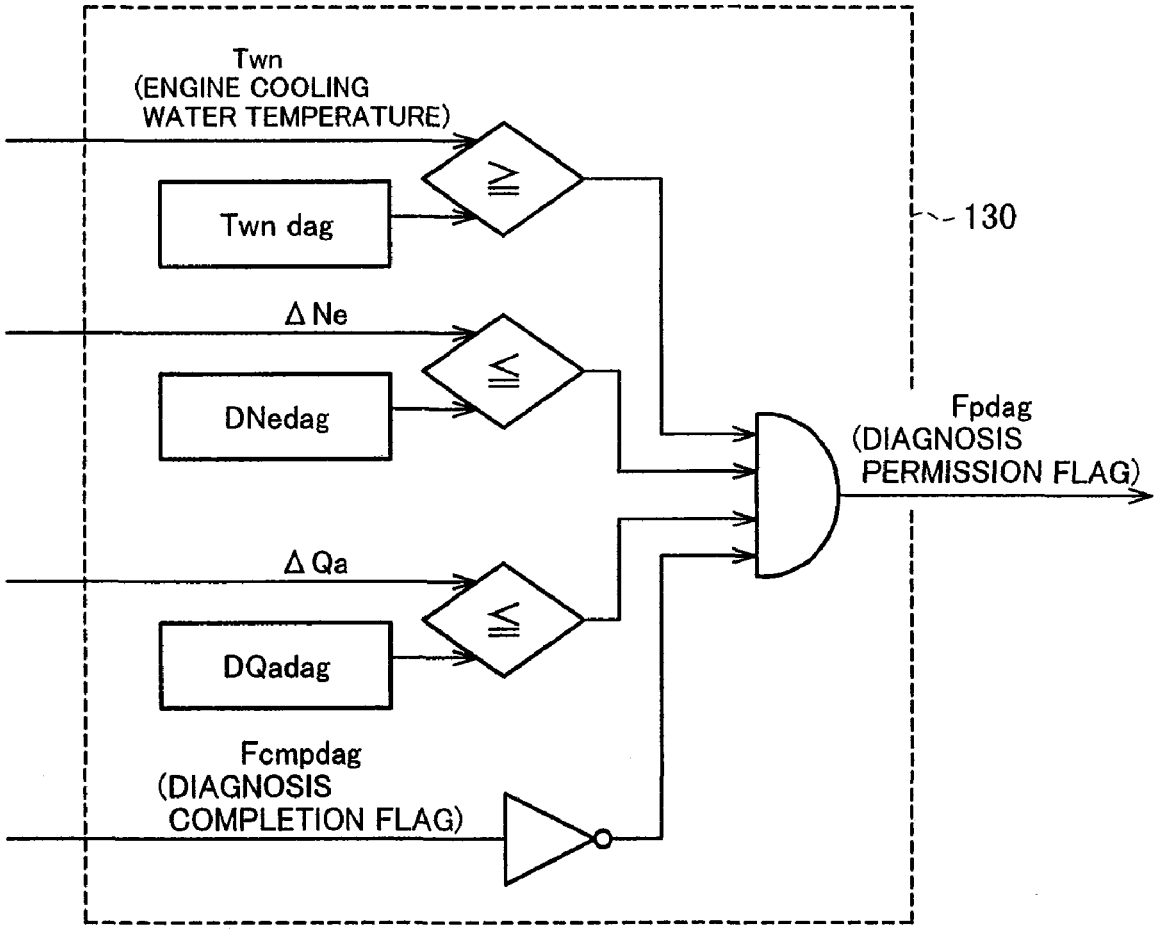
FIG. 30 is a block diagram for explaining an A/F-sensor diagnosis permission determining unit in the first embodiment.

This determining unit 130 determines whether diagnosis of the A/F sensor 52 is permitted or not. In practice, as shown in FIG. 30, on condition of Twn ≧ Twndag, ΔNe ≦ DNedag, ΔQa ≦ DQadag, and Fcmpdag=0, a diagnosis (detection of response characteristic) permission flag Fpdag=1 is set to permit the detection of response characteristic. Otherwise, the diagnosis is inhibited and Fpdag=0 is set.

The parameters in FIG. 30 are defined as follows:

Twn: engine cooling water temperature

ΔNe: engine RPM change rate

ΔQa: air intake change rate

Fcmpdag: diagnosis completion flag

Note that ΔNe and ΔQa may be each given as a difference between a value computed in the preceding job and a value computed in the current job.

<A/F Ratio Correction Amount Computing Unit 122>

Figure 31:
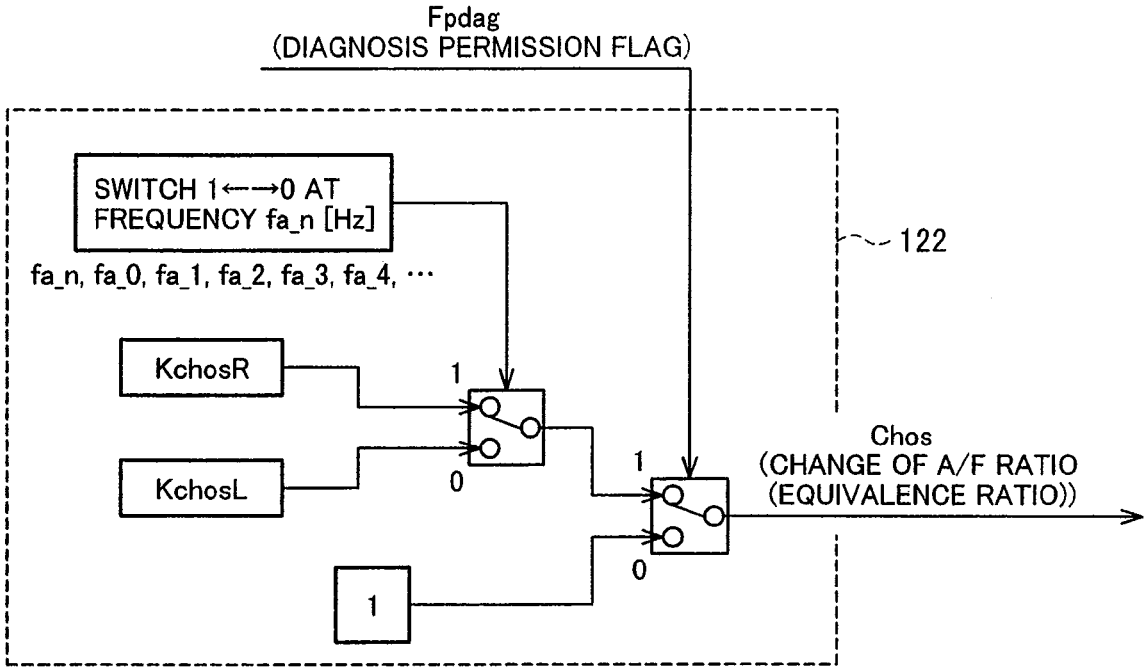
FIG. 31 is a block diagram for explaining an A/F ratio correction amount computing unit in the first embodiment.

This computing unit 122 computes an A/F ratio correction amount. In an ordinary state, i.e., in the case of the diagnosis permission flag Fpdag=0, the fuel injection amount for each of the cylinders #1, #2, #3 and #4 is computed from the basic fuel injection amount Tp and the A/F ratio correction term Lalpha so that the A/F ratio in the exhaust joining portion 40B is equal to the target A/F ratio. In the case of Fpdag=1, the equivalence ratio for all the cylinders is switched over at a frequency fa_n [Hz] between KchosR and KchosL, thereby causing the A/F ratio to oscillate in the exhaust joining portion 40B. In practice, the processing is executed as shown in FIG. 31. More specifically, in the case of Fpdag=1, Chos (A/F ratio change) is cyclically switched over at a frequency fa_n [Hz] between KchosR and KchosL. In the case of Fpdag=0, Chos=0 is set. Respective values of KchosR and KchosL are preferably set in match with characteristics of the engine and the catalyst so as to prevent exhaust emissions from becoming worse. Further, to detect a frequency response characteristic of the A/F sensor 52, the output of the A/F sensor 52 must be measured while oscillating the A/F ratio at a plurality of frequencies. Thus, the frequency fa_n at which the A/F ratio is oscillated is not one, but it is changed to plural values fa__0, fa__1, etc., as shown in FIG. 31.

As described above, in the A/F ratio control unit 120, the basic fuel injection amount Tp is corrected in accordance with the A/F-ratio F/B correction amount and the A/F ratio correction amount, whereby a final fuel injection amount Ti0 is obtained. An injection driving (pulse) signal (i.e., an A/F ratio control signal) with a pulse width corresponding to the final fuel injection amount Ti0 is supplied to each fuel injector valve 30 at predetermined timing.

<Frequency Response Characteristic Computing Unit 140>

Figure 32:
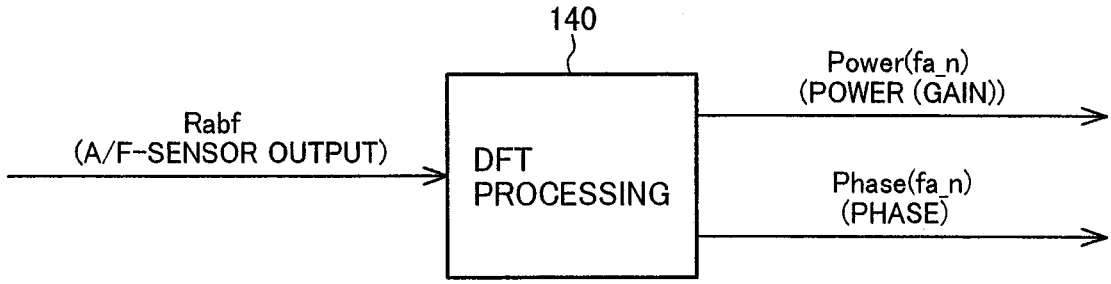
FIG. 32 is a block diagram for explaining a frequency response characteristic computing unit in the first embodiment.

This computing unit 140 executes a frequency analysis of the signal obtained from the A/F sensor 52. In practice, as shown in FIG. 32, the output signal of the A/F sensor 52 is subjected to processing with DFT (Discrete Fourier Transform), to thereby compute a power spectrum (=gain characteristic) Power(fa_n) and a phase spectrum Phase(fa_n) at the frequency fa_n. In this embodiment, DFT was used instead of FFT (Fast Fourier Transform) for the reason of computing the spectrum only at the particular frequency. Note that processing procedures with DFT are discussed in many references and books, and therefore not described here.

<A/F Sensor Diagnosis Unit 150>

Figure 33:
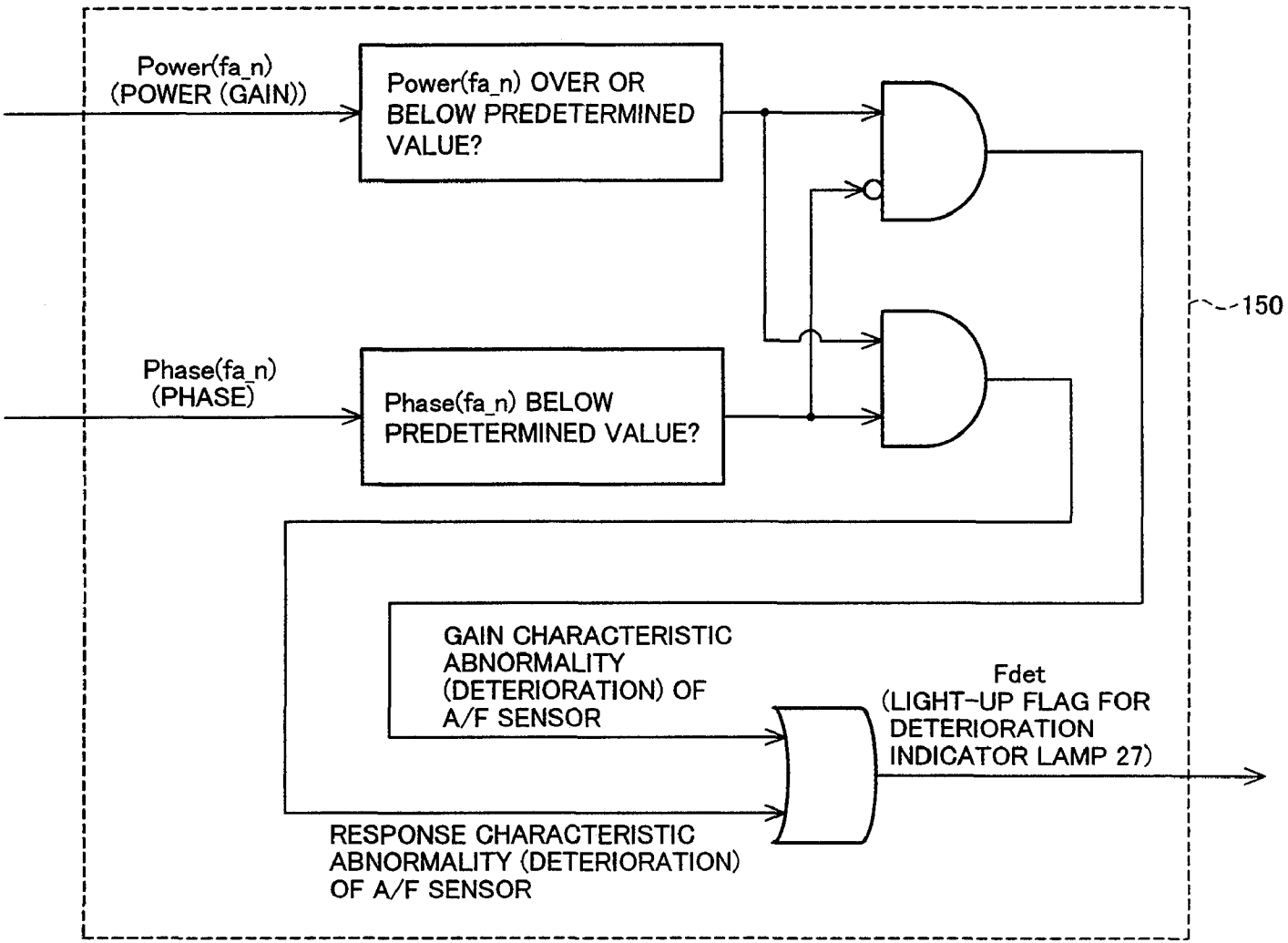
FIG. 33 is a block diagram for explaining an A/F sensor diagnosis unit in the first embodiment.

This diagnosis unit 150 diagnoses the A/F sensor 52 by using Power(fa_n) and Phase(fa_n) both computed by the frequency response characteristic computing unit 140. In practice, as shown in FIG. 33, the diagnosis unit 150 determines that the gain characteristic of the A/F sensor 52 has changed, when the gain characteristic Power(fa_n) is over a predetermined value or below a predetermined value and the phase characteristic Phase(fa_n) is not below a predetermined value, i.e., when only the gain characteristic is changed. On the other hand, the diagnosis unit 150 determines that the response characteristic of the A/F sensor 52 has changed, when the gain characteristic Power(fa_n) is over the predetermined value or below the predetermined value and the phase characteristic Phase(fa_n) is below the predetermined value, i.e., when both the gain characteristic and the phase characteristic are changed. Further, when any of the gain characteristic and the response characteristic of the A/F sensor 52 has changed, a deterioration indicator lamp 27 is lit up (Fdet=1), for example, to inform the driver of the deterioration of the A/F sensor 52. It is desired that the predetermined values mentioned above be empirically decided depending on not only the characteristics of the engine 10 and the three-way catalyst 50, but also the target diagnosis performance.

According to this embodiment, as described above, since the A/F sensor 52 is diagnosed based on the frequency response characteristic in a range from the fuel injector valve 30 to the A/F sensor 52, it is possible to precisely determine whether the deterioration mode of the A/F sensor 52 is the gain characteristic or the response characteristic.

Second Embodiment

Figure 34:
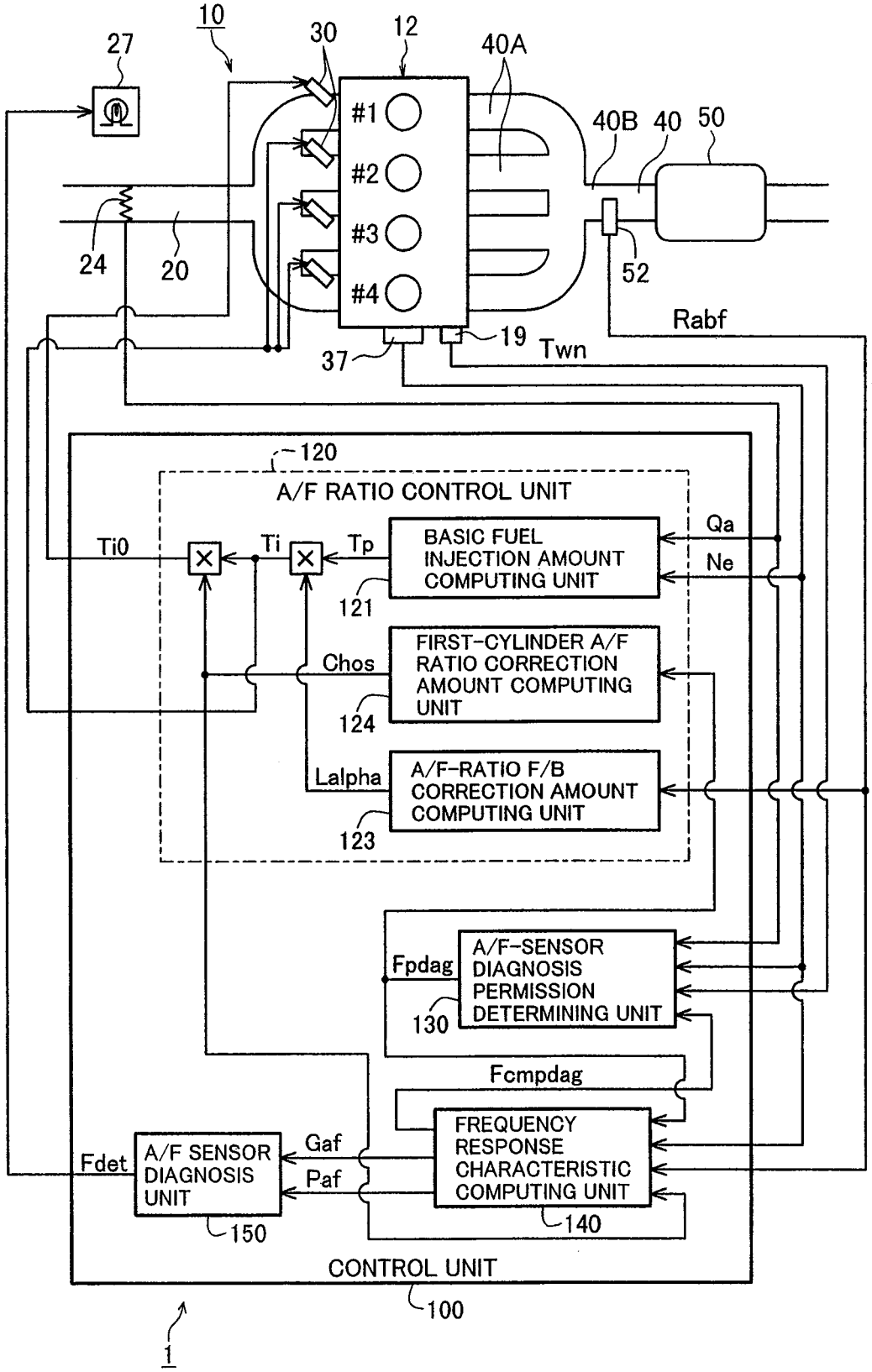
FIG. 34 is a block diagram of a control system in the second embodiment.

A second embodiment of the engine controller according to the present invention will be described below. Various components of the second embodiment are of substantially the same configurations as those of the above-described first embodiment (FIGS. 24 to 33) except for the A/F ratio control unit 120. Therefore, overlap of the description is avoided here and the A/F ratio control unit 120 used in the second embodiment will be described with reference to FIG. 34.

The A/F ratio control unit 120 of this second embodiment differs from the A/F ratio control unit 120 (FIG. 25) of the first embodiment in that the (all-cylinder) A/F ratio correction amount computing unit 122 is replaced by a first-cylinder A/F ratio correction amount computing unit 124 and the correction amount Chos is reflected only on the A/F ratio (fuel injection amount) of the first cylinder #1. The following description is made primarily of different points from the first embodiment.

<First-Cylinder A/F Ratio Correction Amount Computing Unit 124>

Figure 35:
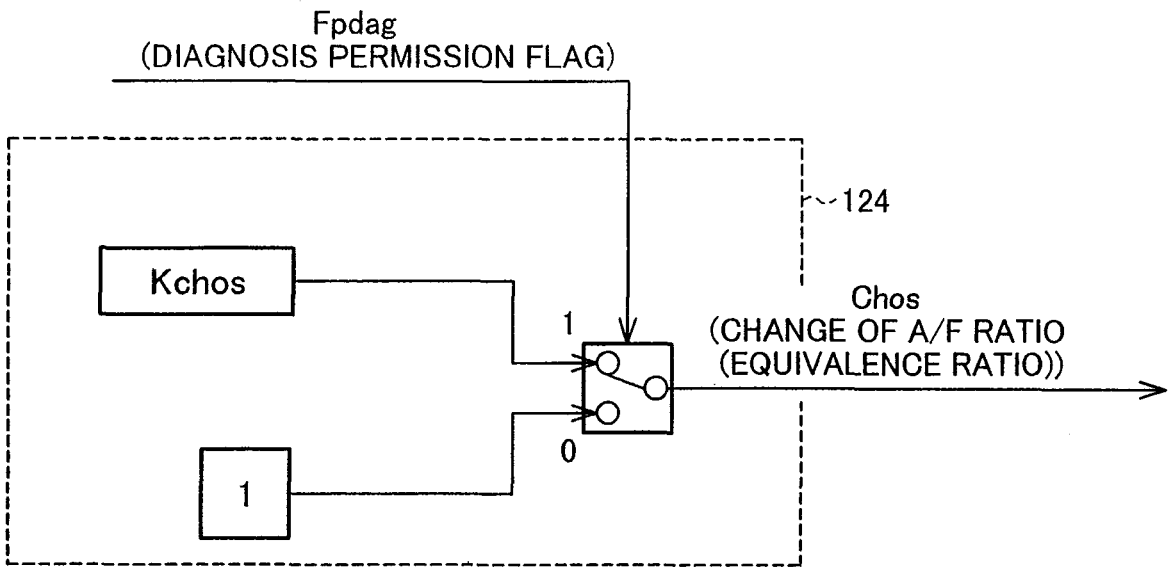
FIG. 35 is a block diagram for explaining a first-cylinder A/F ratio correction amount computing unit in the second embodiment.

This computing unit 124 computes an A/F ratio correction amount for the first cylinder #1. In an ordinary state, i.e., in the case of Fpdag=0, the fuel injection amount for each of the cylinders #1, #2, #3 and #4 is computed from the basic fuel injection amount Tp and the A/F ratio correction term Lalpha so that the A/F ratio in the exhaust joining portion 40B is equal to the target A/F ratio. In the case of Fpdag=1, the equivalence ratio for only the first cylinder #1 is increased by a predetermined amount Kchos, thus causing the A/F ratio to oscillate in the exhaust joining portion 40B. In practice, the processing is executed as shown in FIG. 35. More specifically, in the case of Fpdag=1, a change Chos of the first-cylinder equivalence ratio is set to Kchos (i.e., Chos=Kchos). In the case of Fpdag=0, Chos=0 is set. A value of Kchos is preferably set in match with characteristics of the engine and the catalyst so that exhaust emissions will not become worse.

<Frequency Response Characteristic Computing Unit 140>

Figure 36:
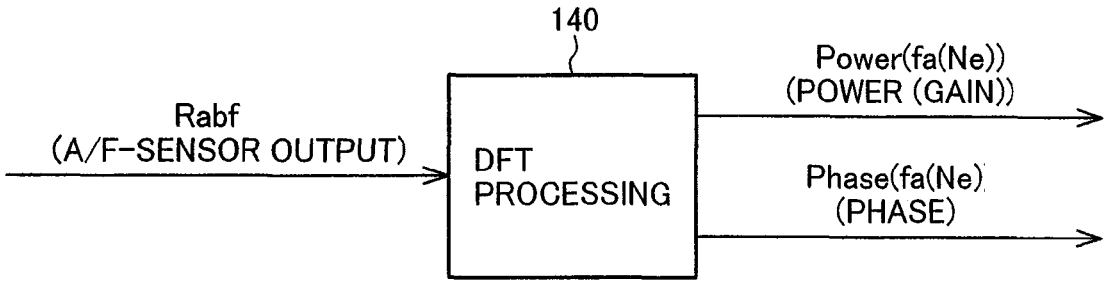
FIG. 36 is a block diagram for explaining a frequency response characteristic computing unit in the second embodiment.

This computing unit 140 executes a frequency analysis of the signal obtained from the A/F sensor 52. In practice, as shown in FIG. 36, the output signal of the A/F sensor 52 is subjected to processing with DFT (Discrete Fourier Transform), to thereby compute a power spectrum (=gain characteristic) Power(fa) and a phase spectrum Phase(fa) at a frequency fa corresponding to the 2-revolution cycle of the engine. FIG. 36 shows the relationship between the frequency fa and the engine RPM Ne corresponding to the 2-revolution cycle of the engine. Stated another way, since the frequency fa is naturally varied depending on the RPM, a frequency characteristic can be roughly determined by computing Power and Phase at plural values of the RPM. In this embodiment, DFT was used instead of FFT (Fast Fourier Transform) for the reason of computing the spectrum only at the particular frequency fa. Further, the sampling theory shows that the sampling cycle is just required to be larger than twice the 2-revolution cycle of the engine. In this embodiment, an interrupt process is executed in accordance with a cylinder signal (outputted per 180° in the 4-cylinder engine) from each crank angle sensor 37 or cam angle sensor.

Third Embodiment

A third embodiment of the engine controller according to the present invention will be described below. Various components of the third embodiment are of substantially the same configurations as those of the above-described second embodiment (FIG. 34) except for only the processing procedures executed by the A/F sensor diagnosis unit 150. Therefore, the following description is made primarily of different points from the second embodiment.

<A/F Sensor Diagnosis Unit 150>

Figure 37:
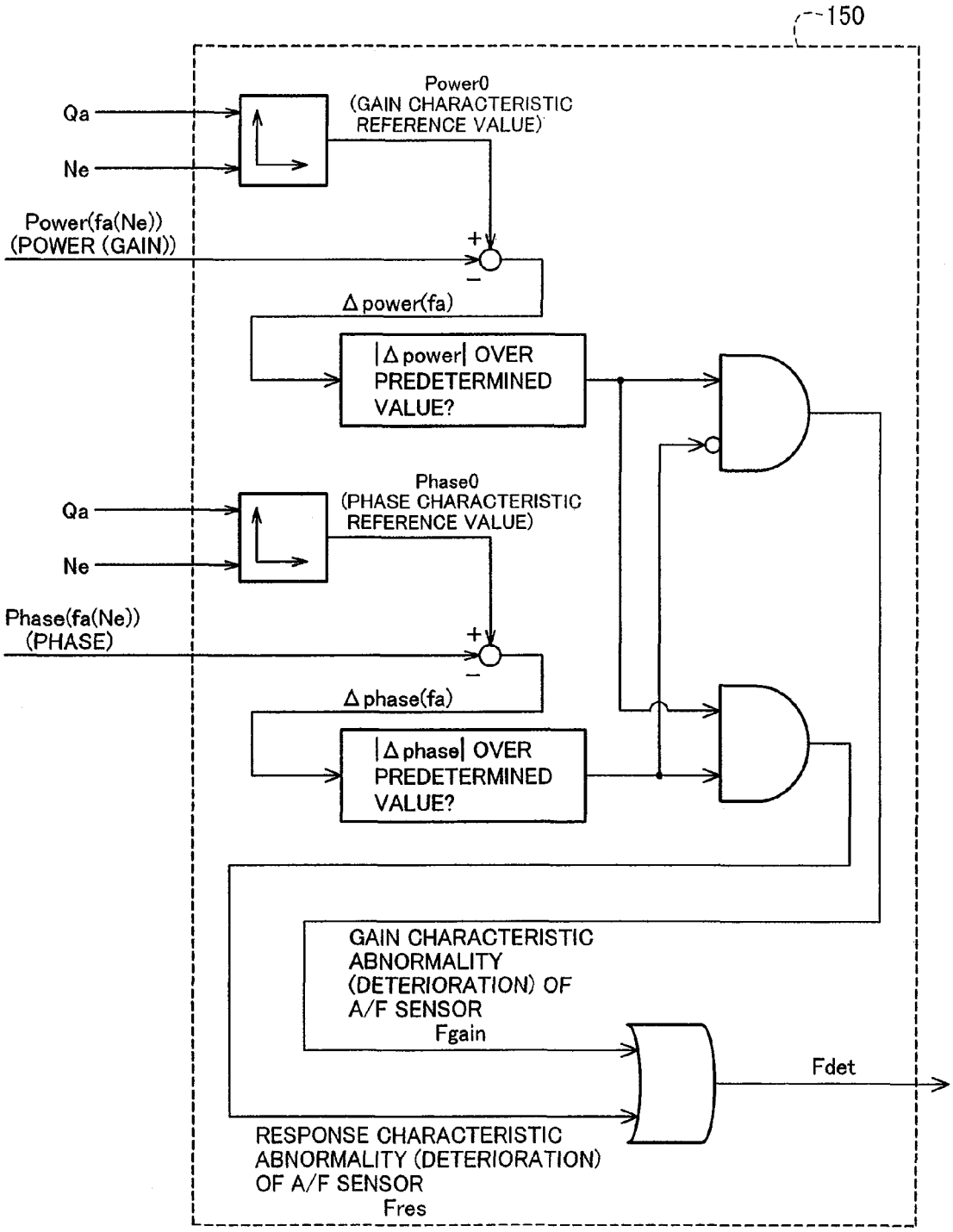
FIG. 37 is a block diagram for explaining an A/F sensor diagnosis unit in the third embodiment.

The A/F sensor diagnosis unit 150 in this third embodiment diagnoses the A/F sensor 52 by using Power(fa(Ne)) and Phase(fa(Ne)) both computed by the frequency response characteristic computing unit 140. In practice, as shown in FIG. 37, the diagnosis unit 150 computes a difference Δpower (fa) between the gain characteristic Power(fa(Ne)) and a gain characteristic reference value Power0. The gain characteristic reference value Power0 is decided in advance, for example, on the basis of a gain characteristic that is obtained under the operating status at a certain air intake Qa and a certain engine RPM Ne (including the value of Kchos) in the normal state of the A/F sensor 52. Also, the diagnosis unit 150 computes a difference Δphase(fa) between the phase characteristic Phase (fa(Ne)) and a phase characteristic reference value Phase0. The phase characteristic reference value Phase0 is decided in advance, for example, on the basis of a phase characteristic that is obtained under the operating status at a certain air intake Qa and a certain engine RPM Ne (including the value of Kchos) in the normal state of the A/F sensor 52. The phase is given as, e.g., a phase relative to the TDC (Top Dead Center) of the engine or the timing of the so-called cylinder determination signal. The diagnosis unit 150 determines that the gain characteristic of the A/F sensor 52 has changed, when the absolute value of Δpower is over a predetermined value and the absolute value of Δphase is below a predetermined value, i.e., when only the gain characteristic is changed. On the other hand, the diagnosis unit 150 determines that the response characteristic of the A/F sensor 52 has changed, when the absolute value of Δpower is over the predetermined value and the absolute value of Δphase is over the predetermined value, i.e., when both the gain characteristic and the phase characteristic are changed. Further, when any of the gain characteristic and the response characteristic of the A/F sensor 52 has changed, the deterioration indicator lamp 27 is lit up (Fdet=1), for example, to inform the driver of the deterioration of the A/F sensor 52. It is desired that the predetermined values mentioned above be empirically decided depending on not only the characteristics of the engine and the catalyst, but also the target diagnosis performance.

Fourth Embodiment

Figure 38:
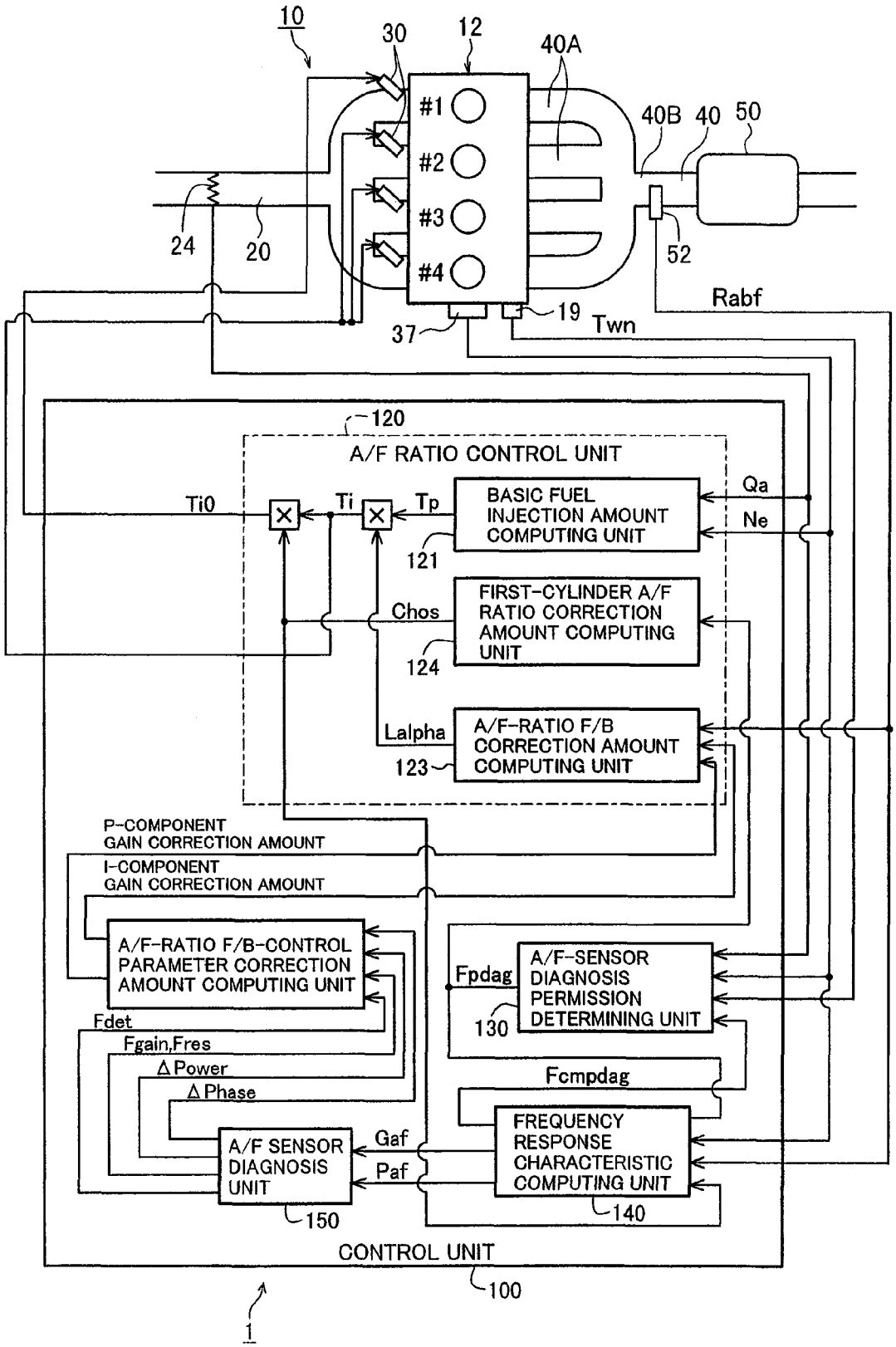
FIG. 38 is a block diagram of a control system in the fourth embodiment.

A fourth embodiment of the engine controller according to the present invention will be described below. Various components of the fourth embodiment are of substantially the same configurations as those of the above-described second embodiment (FIG. 34) except for the processing procedures executed by the A/F-ratio F/B correction amount computing unit 123 and the A/F sensor diagnosis unit 150 and the provision of an A/F-ratio F/B-control parameter correction amount computing unit 160 (see FIG. 38). The following description is made primarily of different points from the second and third embodiments.

<A/F-Ratio F/B Correction Amount Computing Unit 123>

Figure 39:
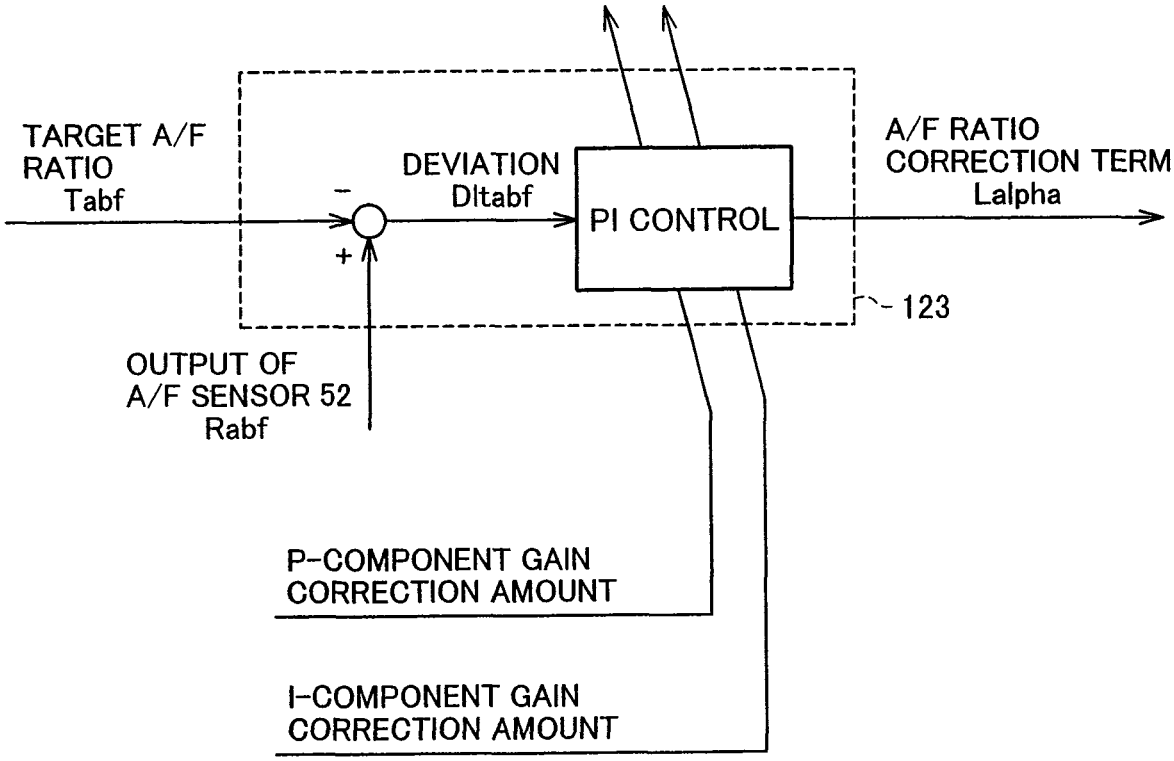
FIG. 39 is a block diagram for explaining an A/F-ratio F/B correction amount computing unit in the fourth embodiment.

In the A/F ratio control unit 120 of this fourth embodiment, A/F ratio feedback control (PI control) is executed based on the A/F ratio detected by the A/F sensor 52 so that an average A/F ratio in the exhaust joining portion 40B (i.e., at an inlet of the three-way catalyst 50) is equal to the target A/F ratio in the operating status under arbitrary conditions. In practice, as shown in FIG. 39, the A/F-ratio F/B correction amount computing unit 123 computes an A/F ratio correction term Lalpha from a deviation Dltabf between a target A/F ratio Tabf and a real A/F ratio Rabf detected by the A/F sensor 52 in the PI control. The A/F ratio correction term Lalpha is multiplied by the basic fuel injection amount Tp. Further, the PI control is optimized depending on a characteristic change (deterioration degree) of the A/F sensor 52 by using a P-component gain correction amount and an I-component gain correction amount which are computed by the A/F-ratio F/B-control parameter correction amount computing unit 160 (described later).

<A/F-Ratio F/B-Control Parameter Correction Amount Computing Unit 160>

Figure 1:
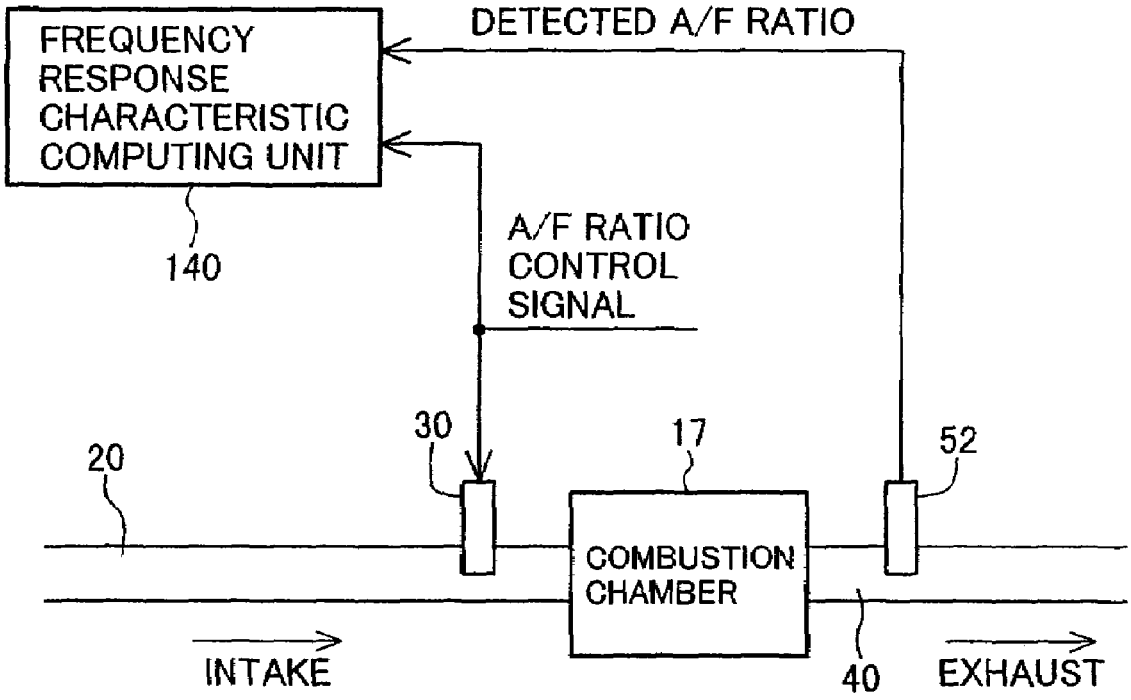
FIG. 1 is a block diagram for explaining a first embodiment of an engine controller according to the present invention.
Figure 2:
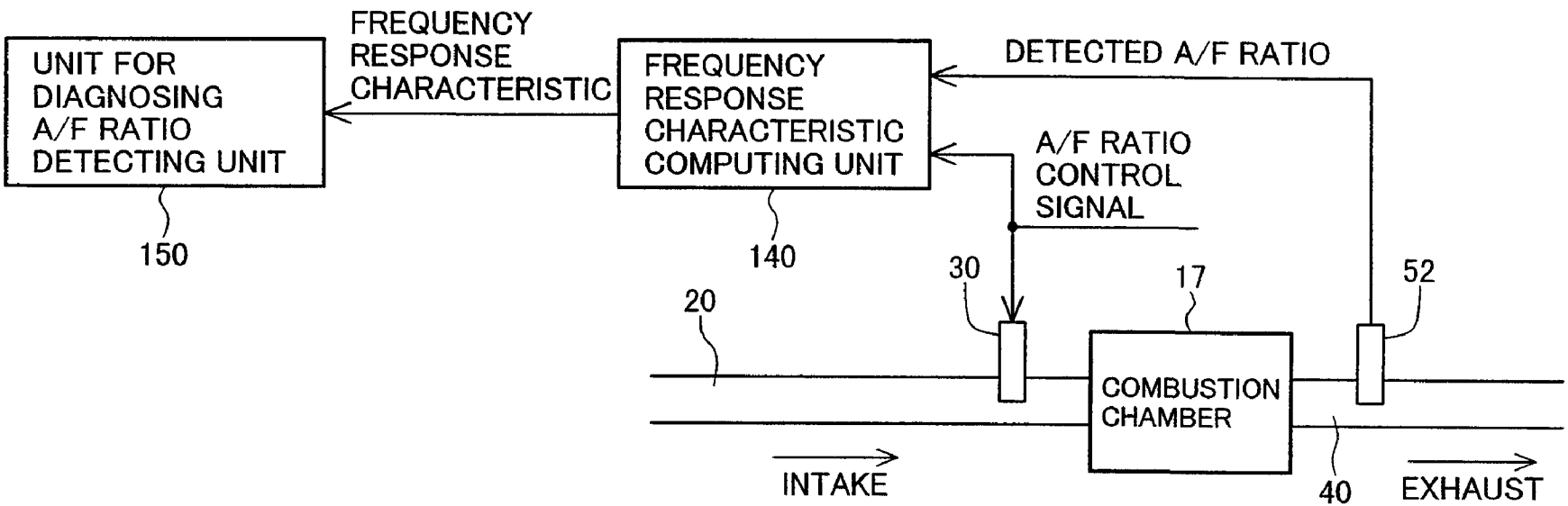
FIG. 2 is a block diagram for explaining a second embodiment of the engine controller according to the present invention.
Figure 3:
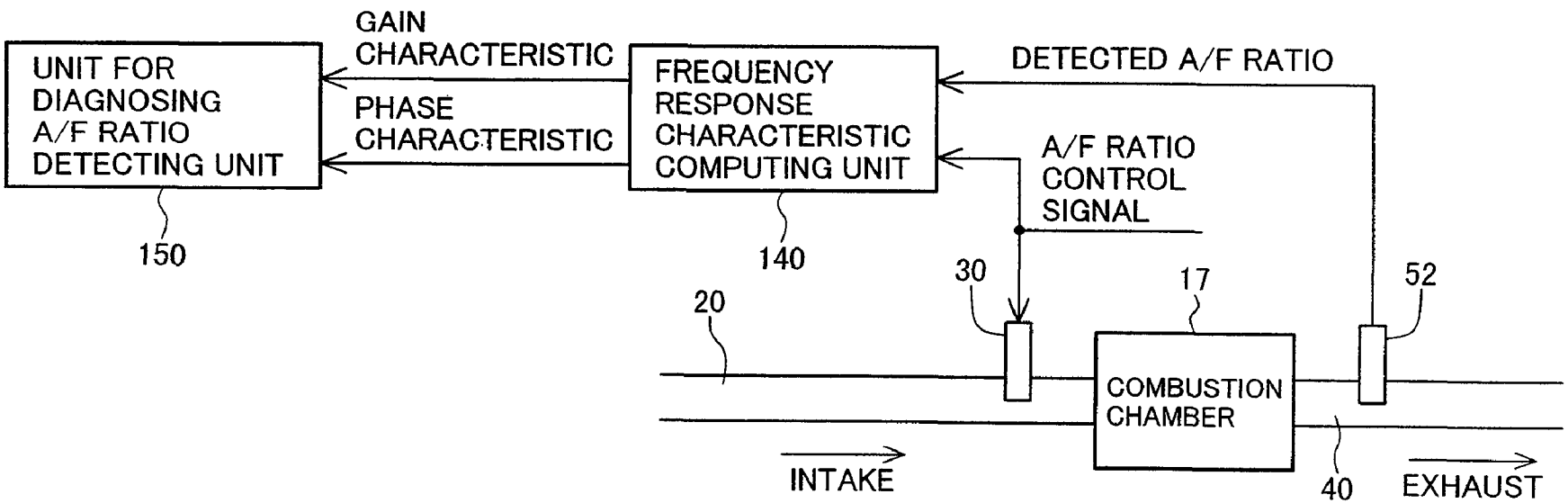
FIG. 3 is a block diagram for explaining a third embodiment of the engine controller according to the present invention.
Figure 4:
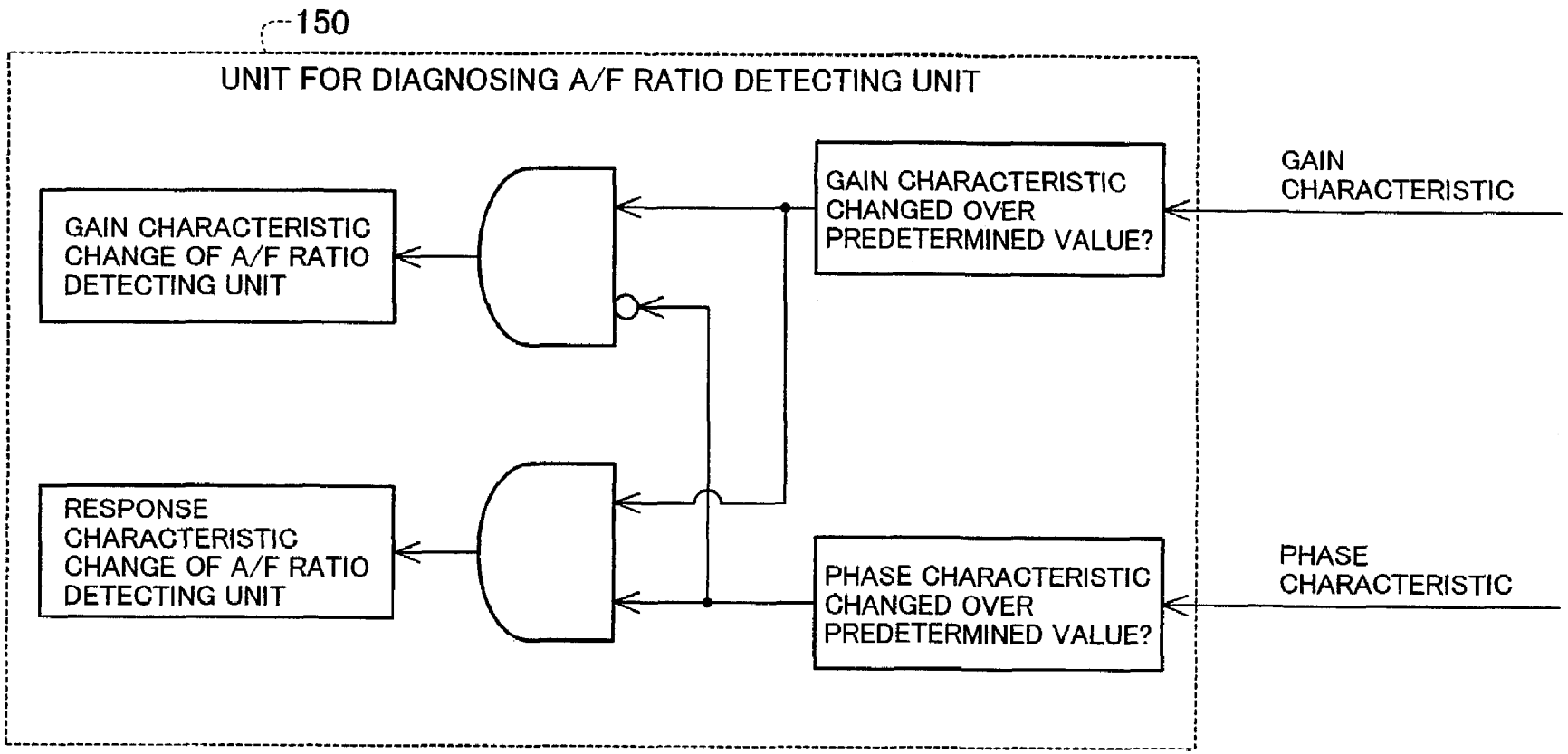
FIG. 4 is a block diagram for explaining a fourth embodiment of the engine controller according to the present invention.
Figure 5:
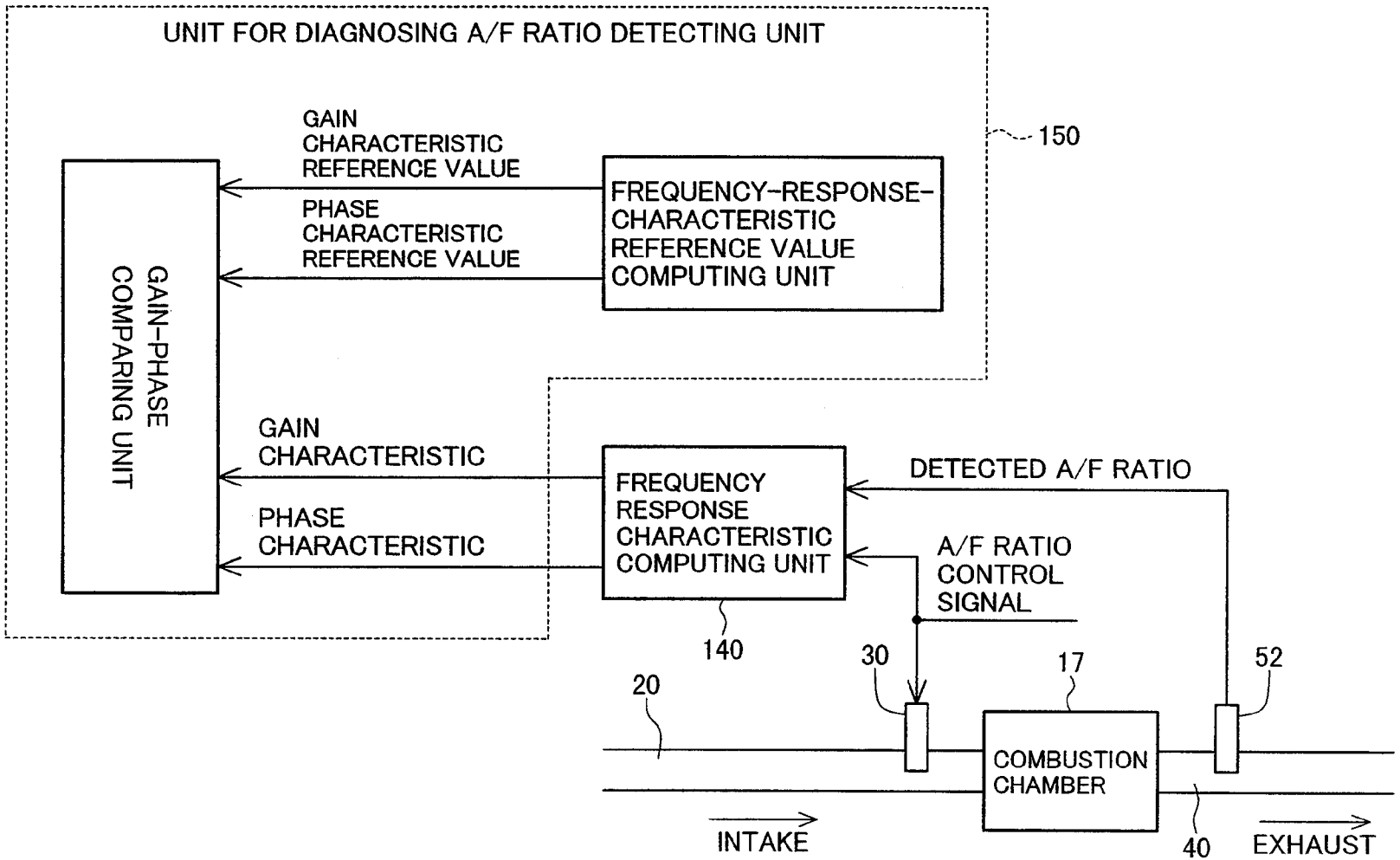
FIG. 5 is a block diagram for explaining a fifth embodiment of the engine controller according to the present invention.
Figure 6:
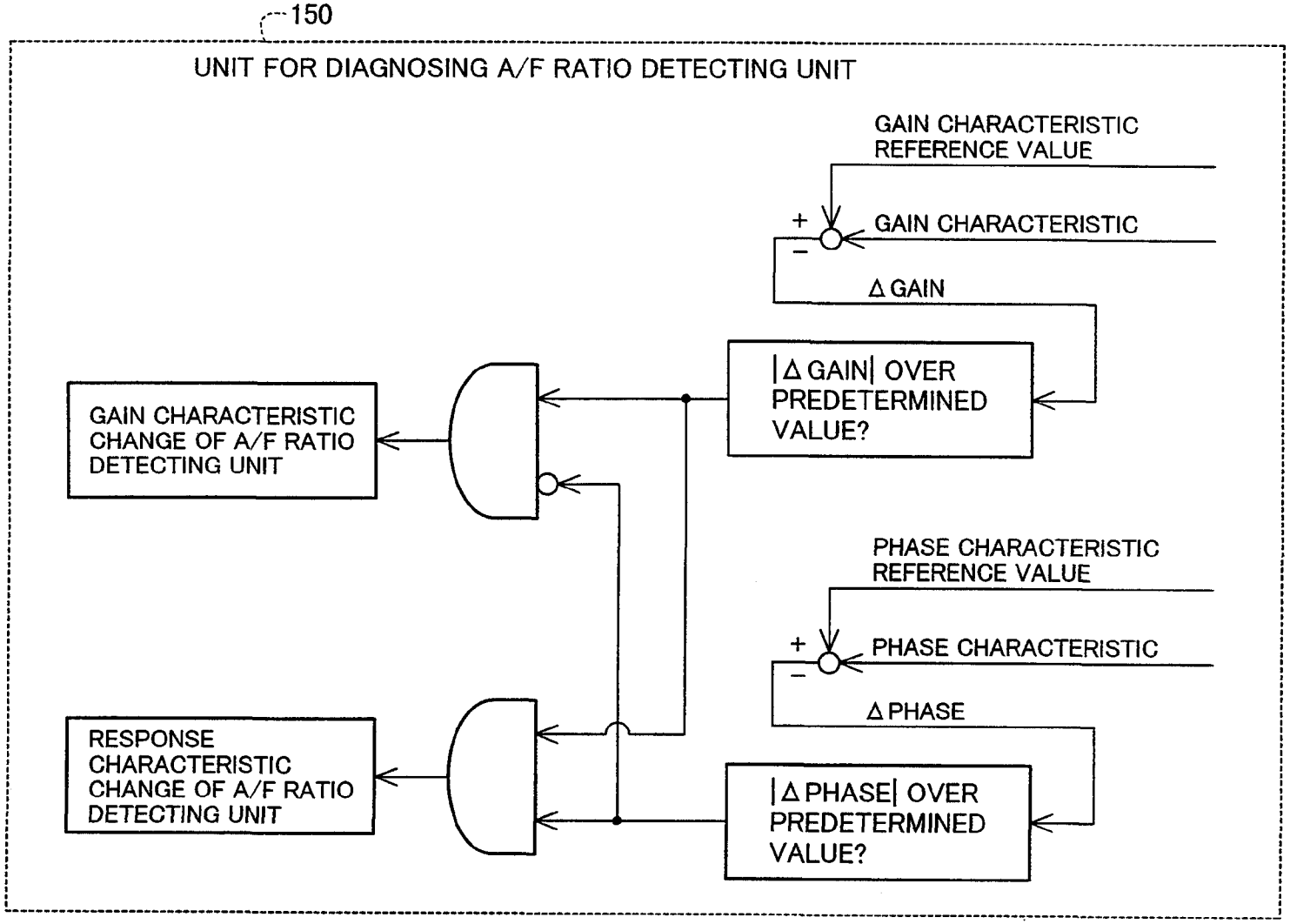
FIG. 6 is a block diagram for explaining a sixth embodiment of the engine controller according to the present invention.
Figure 7:
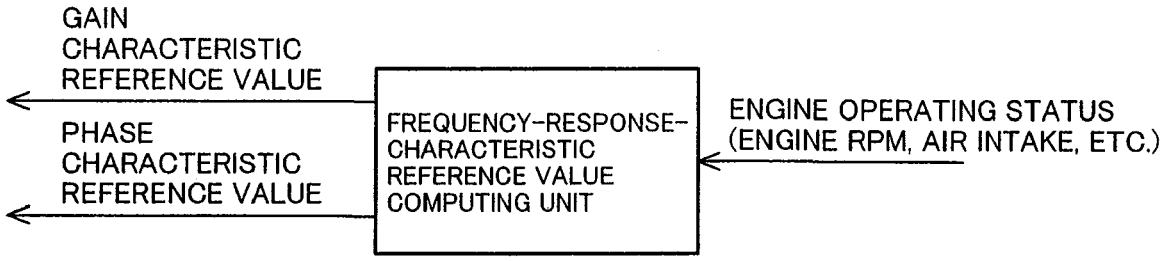
FIG. 7 is a block diagram for explaining a seventh embodiment of the engine controller according to the present invention.
Figure 8:
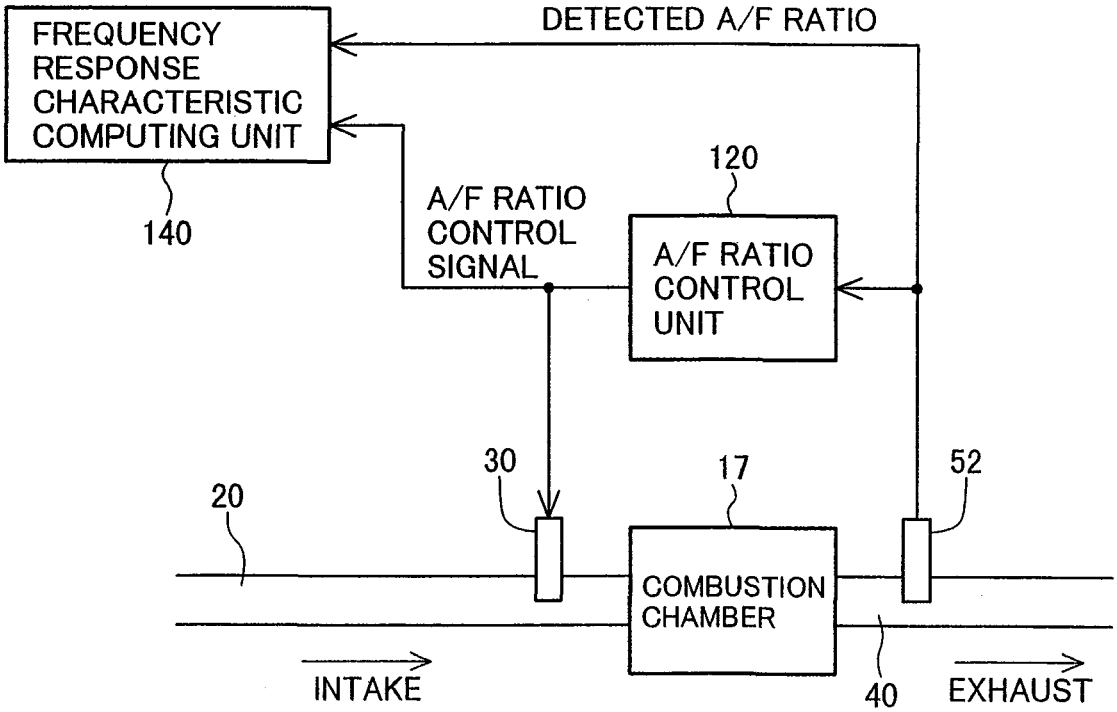
FIG. 8 is a block diagram for explaining a ninth embodiment of the engine controller according to the present invention.
Figure 9:
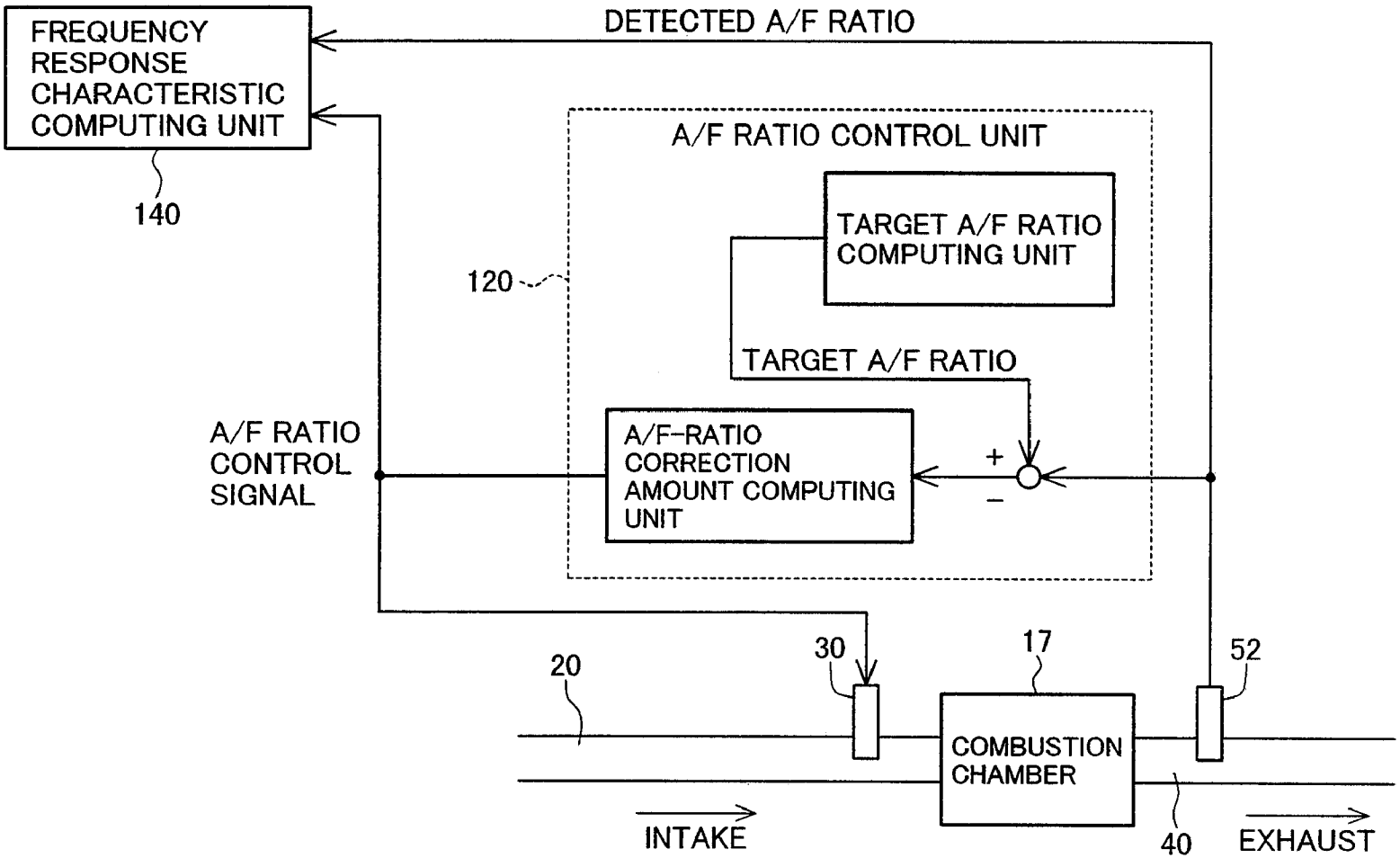
FIG. 9 is a block diagram for explaining a tenth embodiment of the engine controller according to the present invention.
Figure 10:
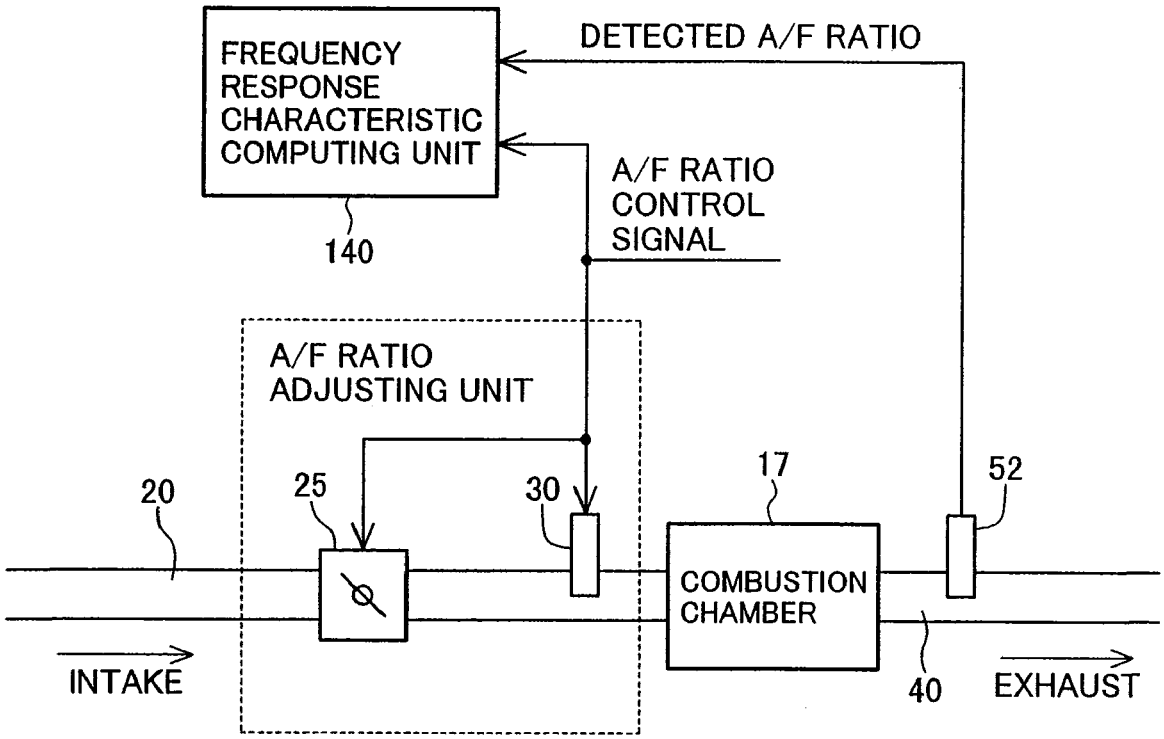
FIG. 10 is a block diagram for explaining an eleventh embodiment of the engine controller according to the present invention.
Figure 11:
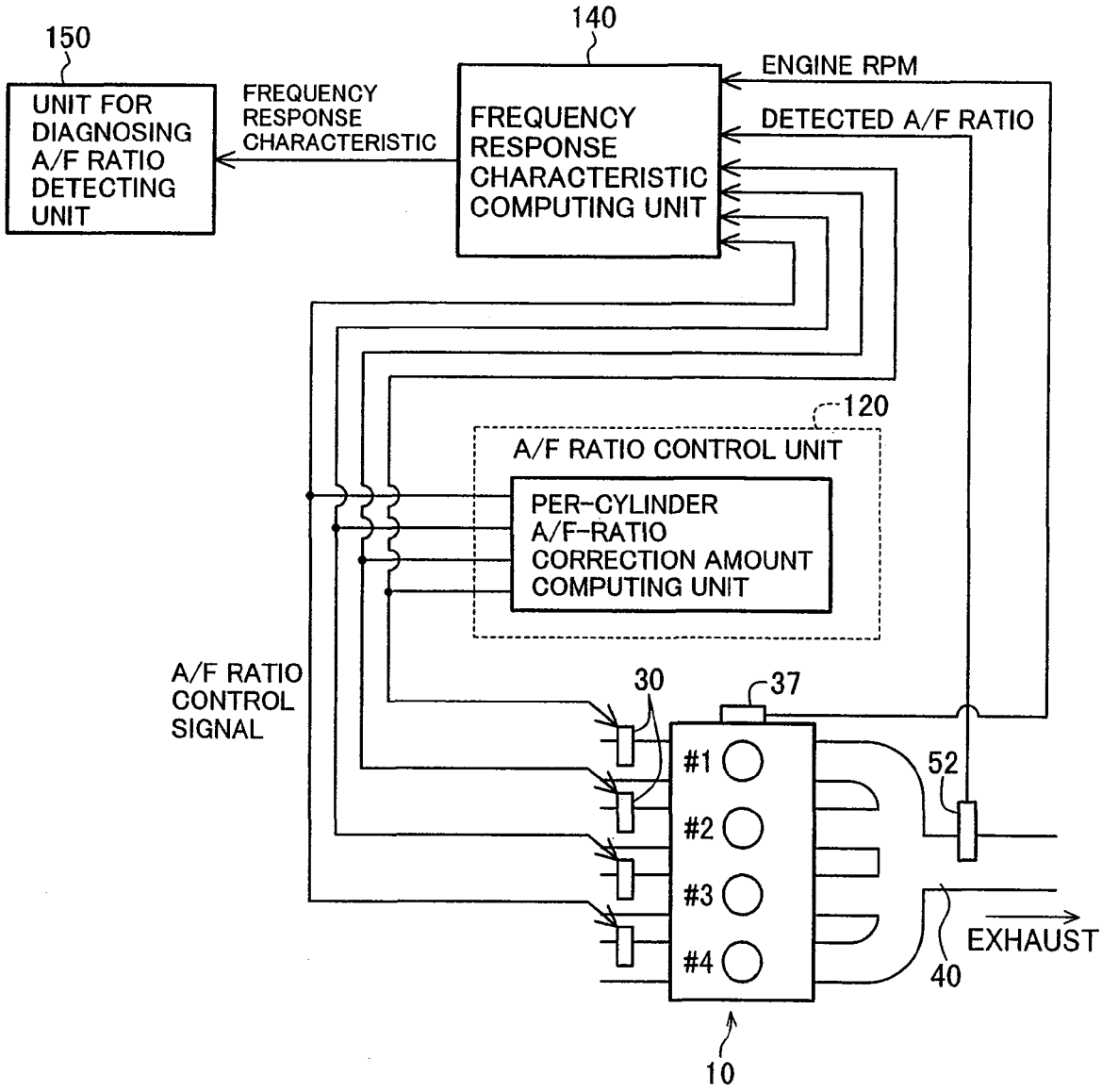
FIG. 11 is a block diagram for explaining a twelfth embodiment of the engine controller according to the present invention.
Figure 12:
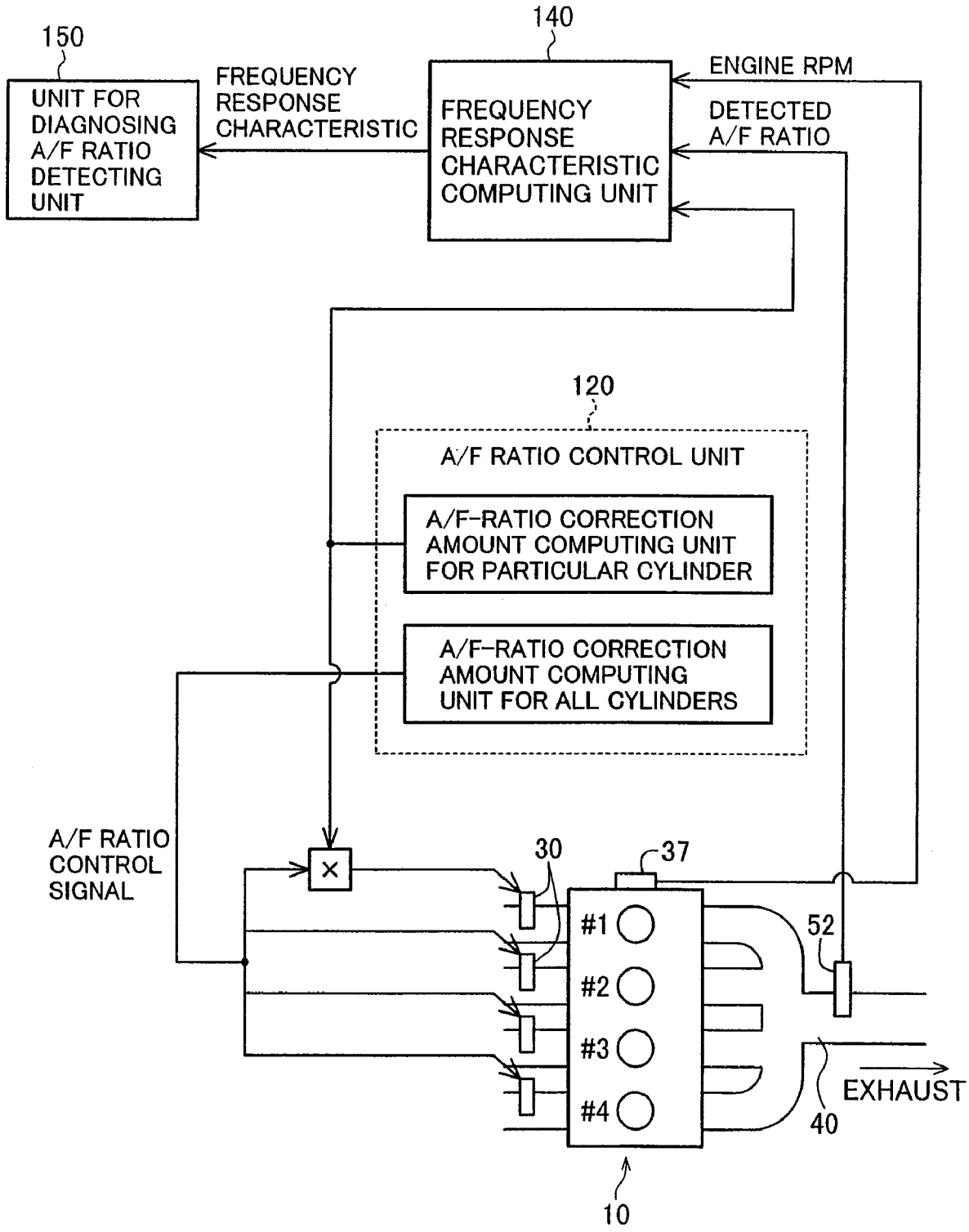
FIG. 12 is a block diagram for explaining a thirteenth embodiment of the engine controller according to the present invention.
Figure 13:
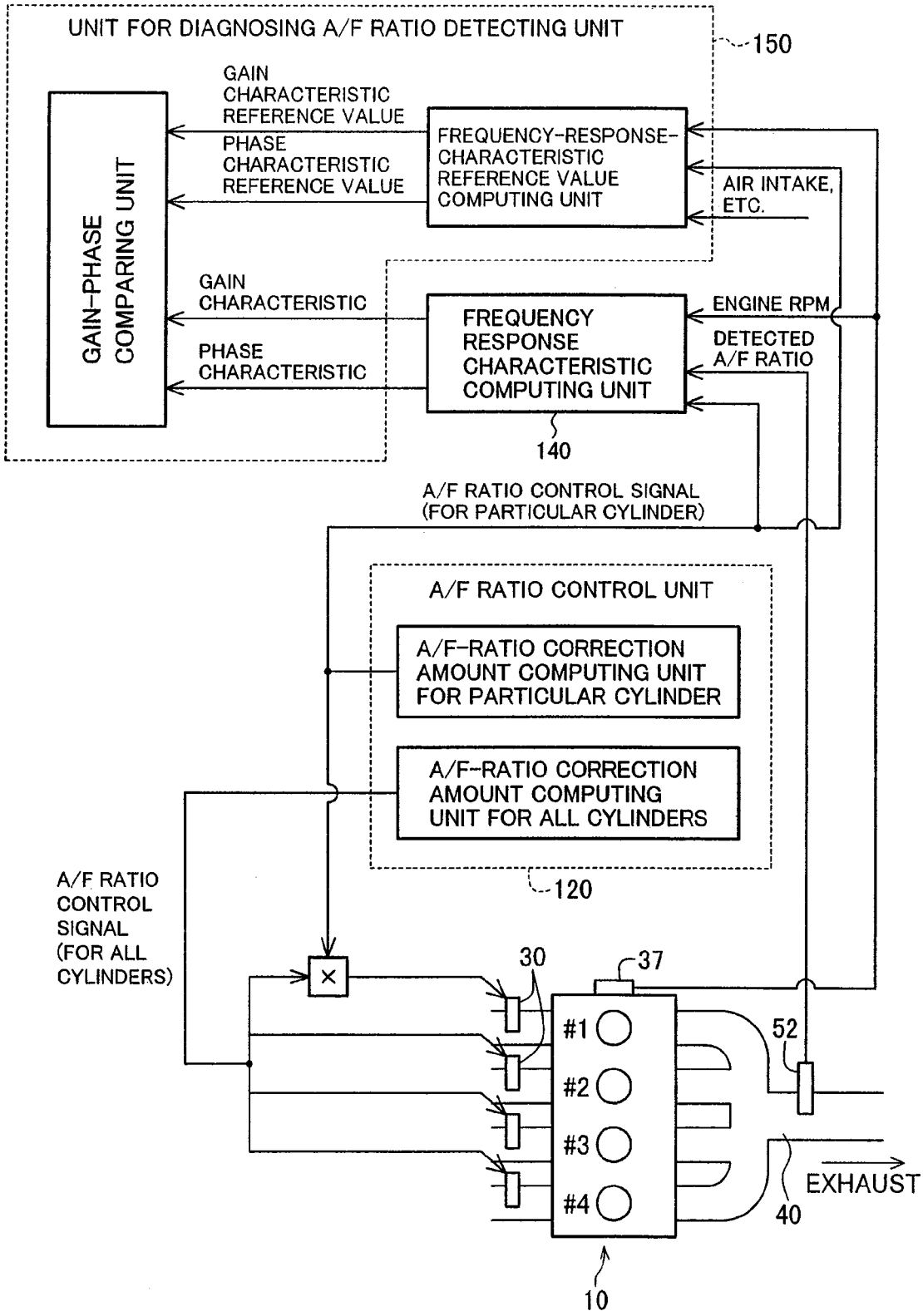
FIG. 13 is a block diagram for explaining a fifteenth embodiment of the engine controller according to the present invention.
Figure 14:
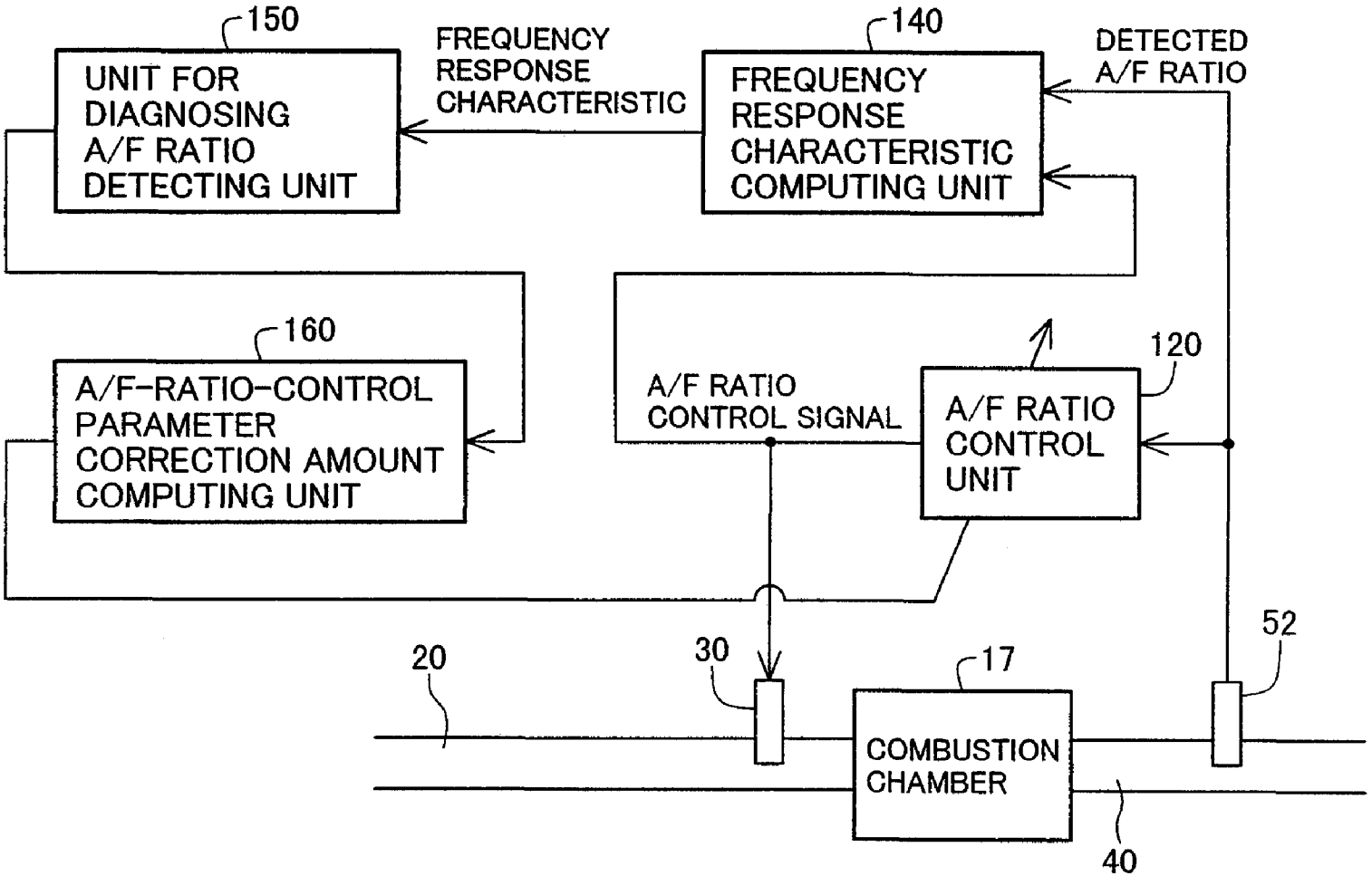
FIG. 14 is a block diagram for explaining a sixteenth embodiment of the engine controller according to the present invention.
Figure 15:
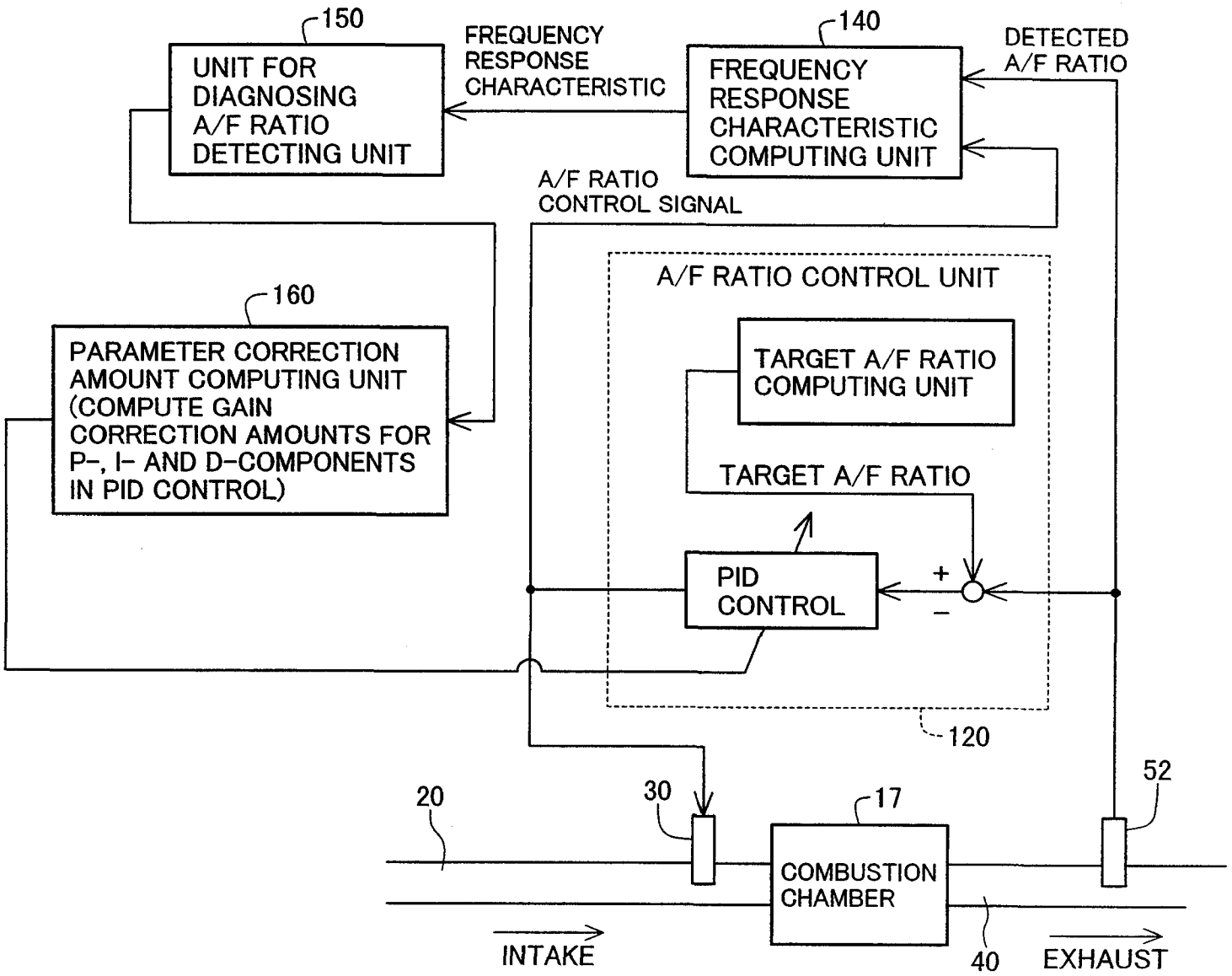
FIG. 15 is a block diagram for explaining a seventeenth embodiment of the engine controller according to the present invention.
Figure 16:
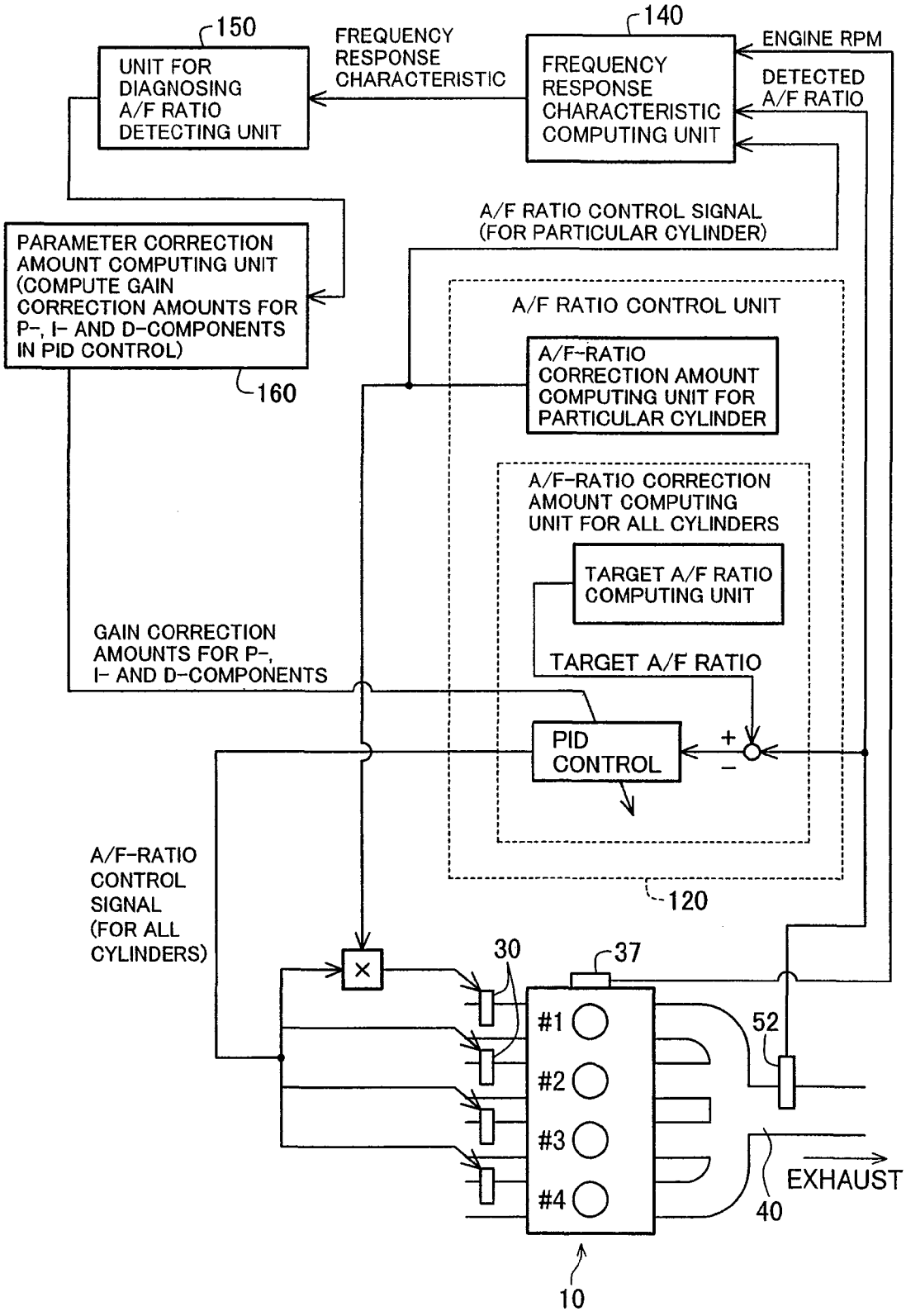
FIG. 16 is a block diagram for explaining an eighteenth embodiment of the engine controller according to the present invention.
Figure 17:
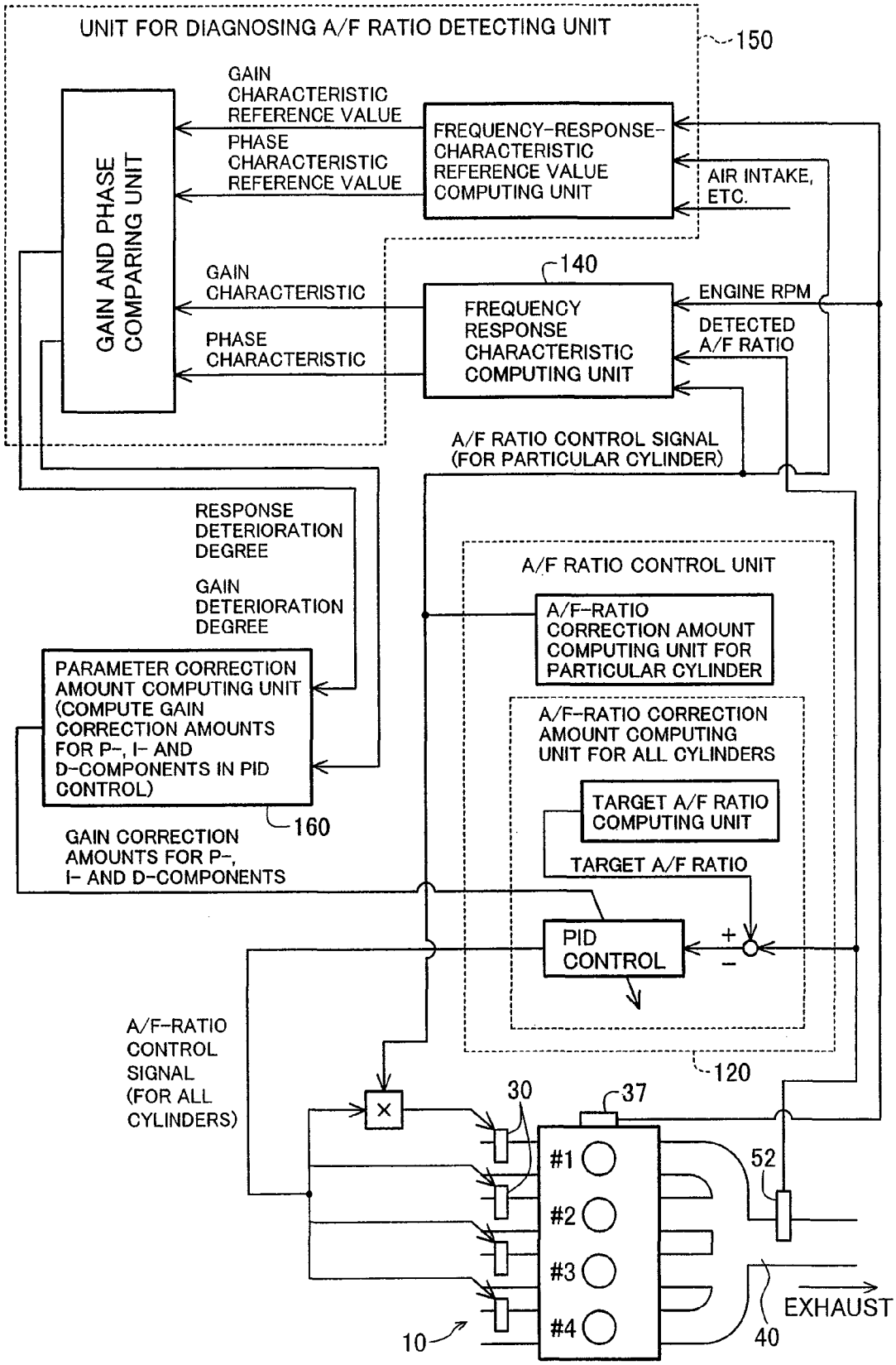
FIG. 17 is a block diagram for explaining a nineteenth embodiment of the engine controller according to the present invention.
Figure 18:
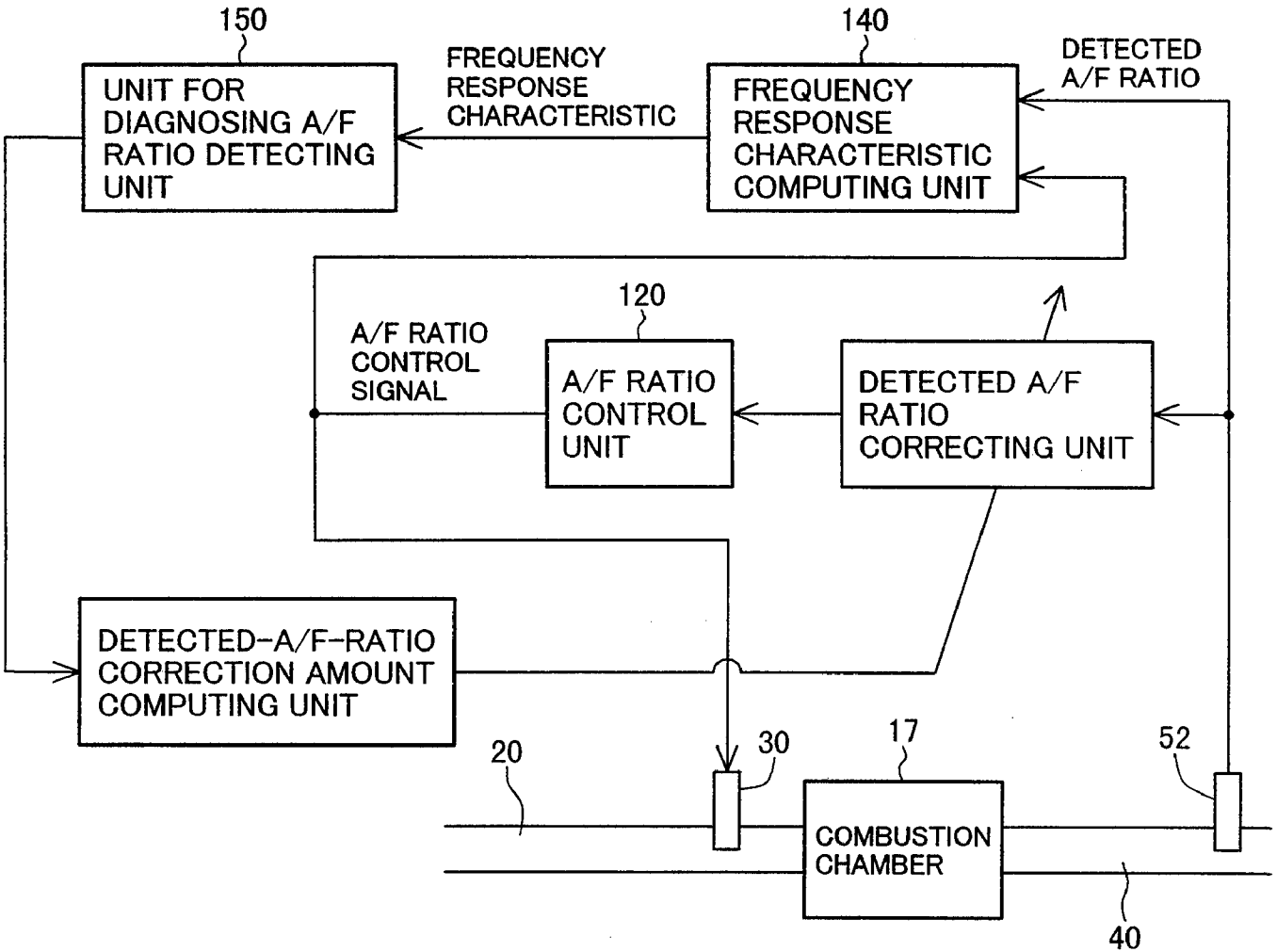
FIG. 18 is a block diagram for explaining a twentieth embodiment of the engine controller according to the present invention.
Figure 19:
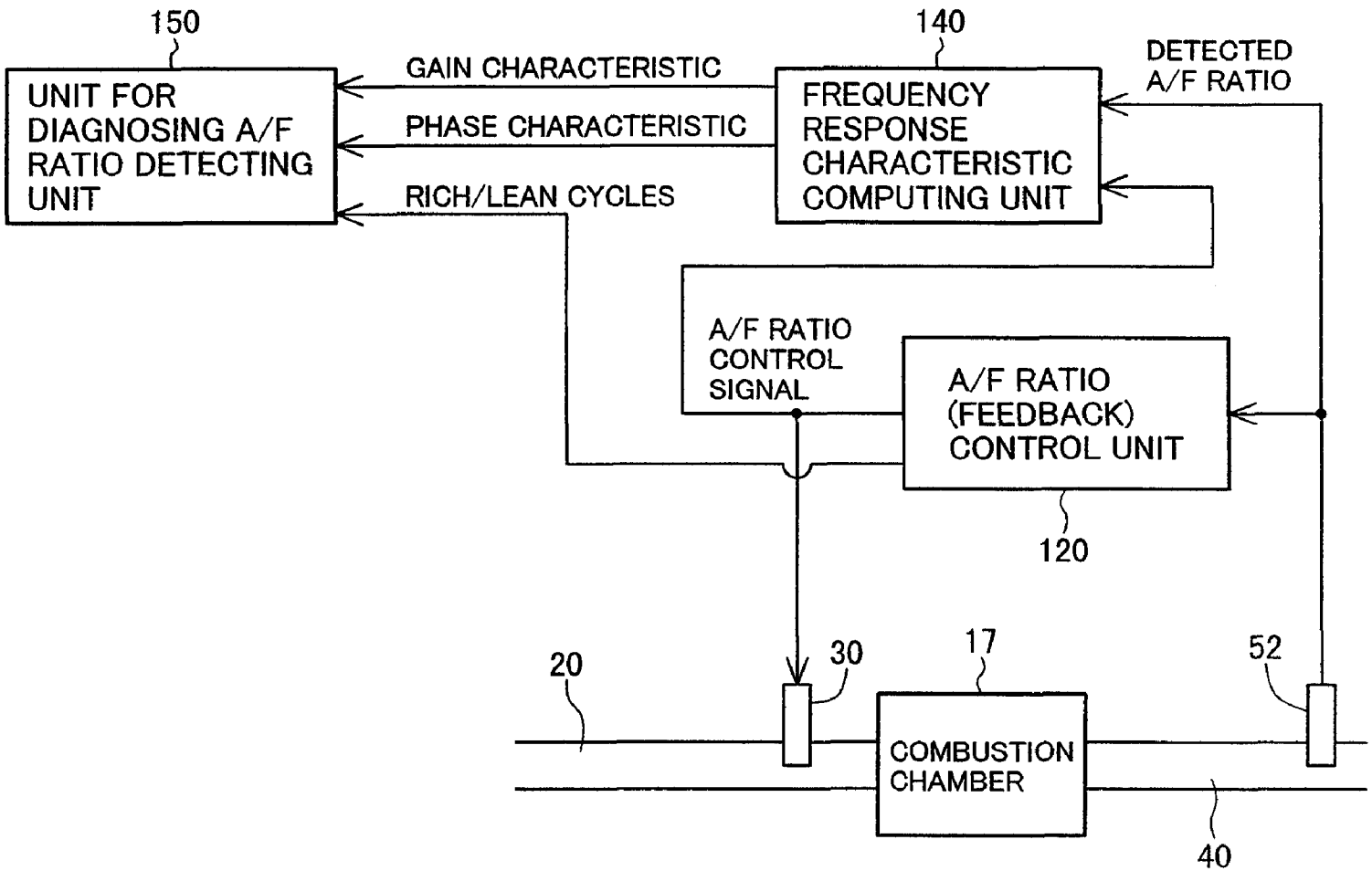
FIG. 19 is a block diagram for explaining a twenty-first embodiment of the engine controller according to the present invention.
Figure 20:
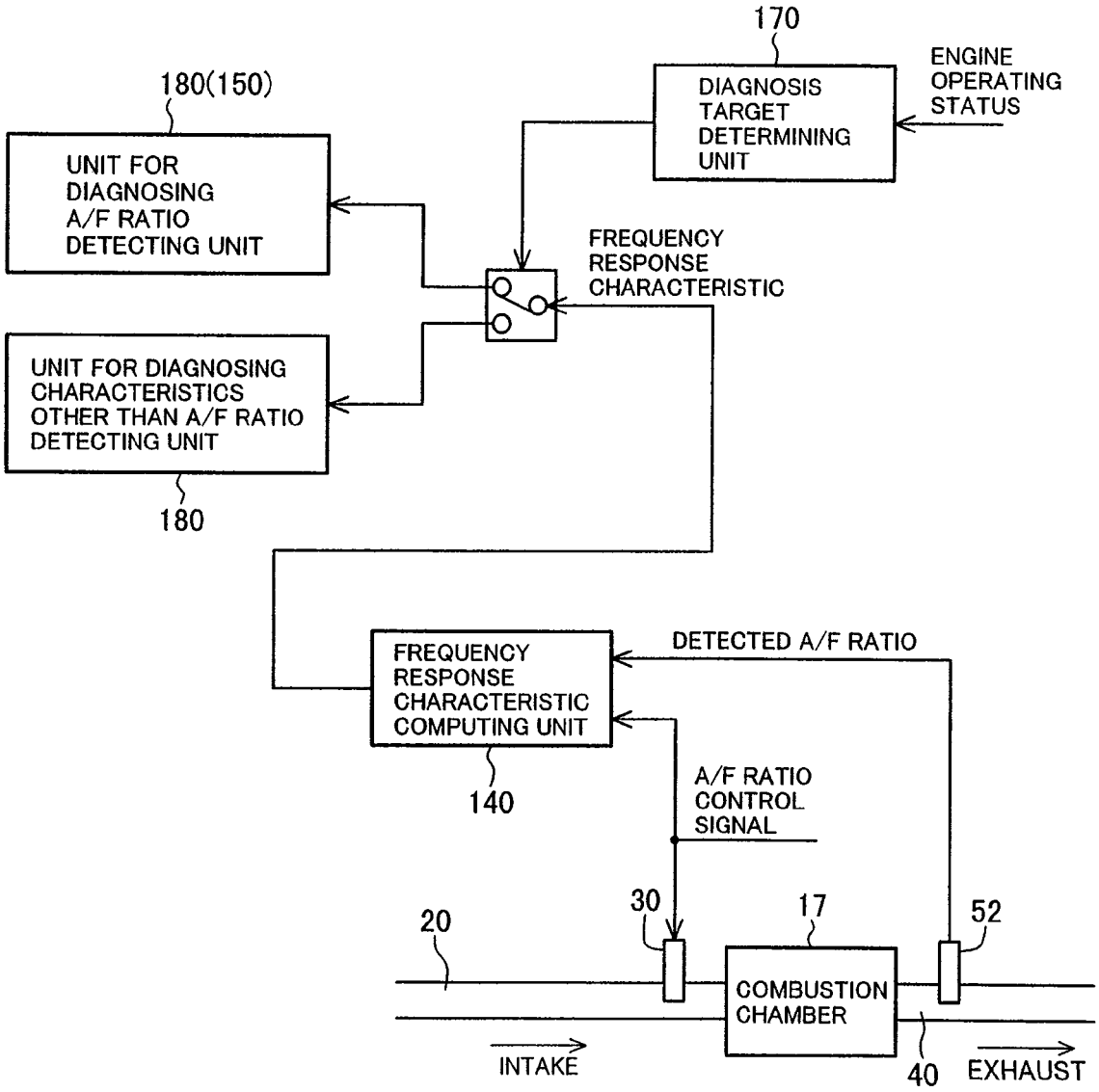
FIG. 20 is a block diagram for explaining a twenty-second embodiment of the engine controller according to the present invention.
Figure 21:
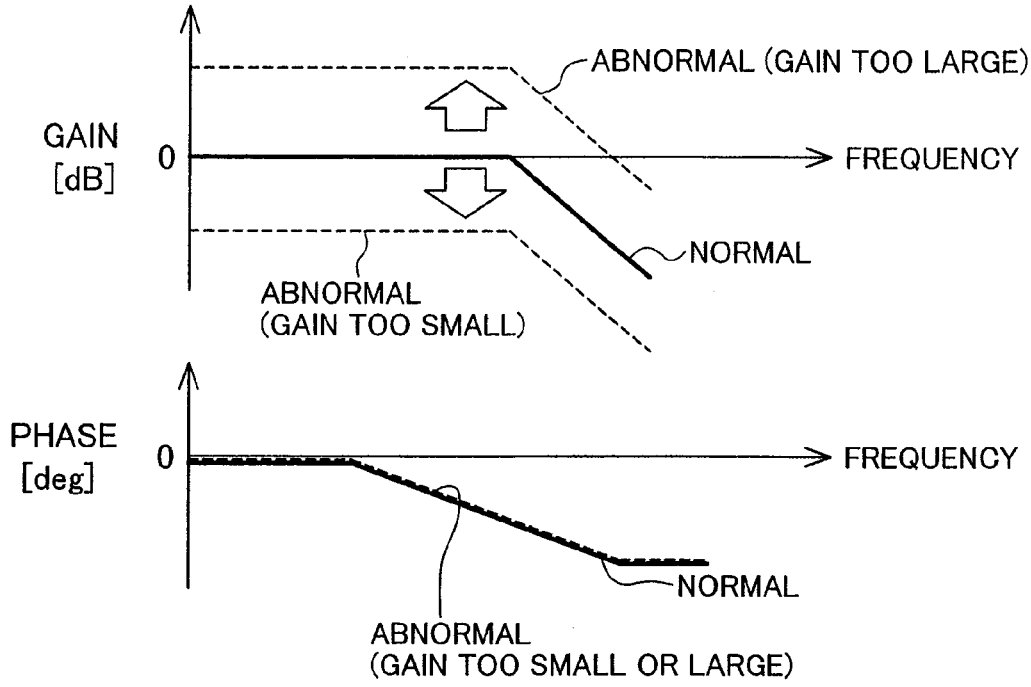
FIG. 21 is a set of graphs each showing a frequency response characteristic when an A/F sensor is normal and when a gain characteristic of the A/F sensor is changed.
Figure 22:
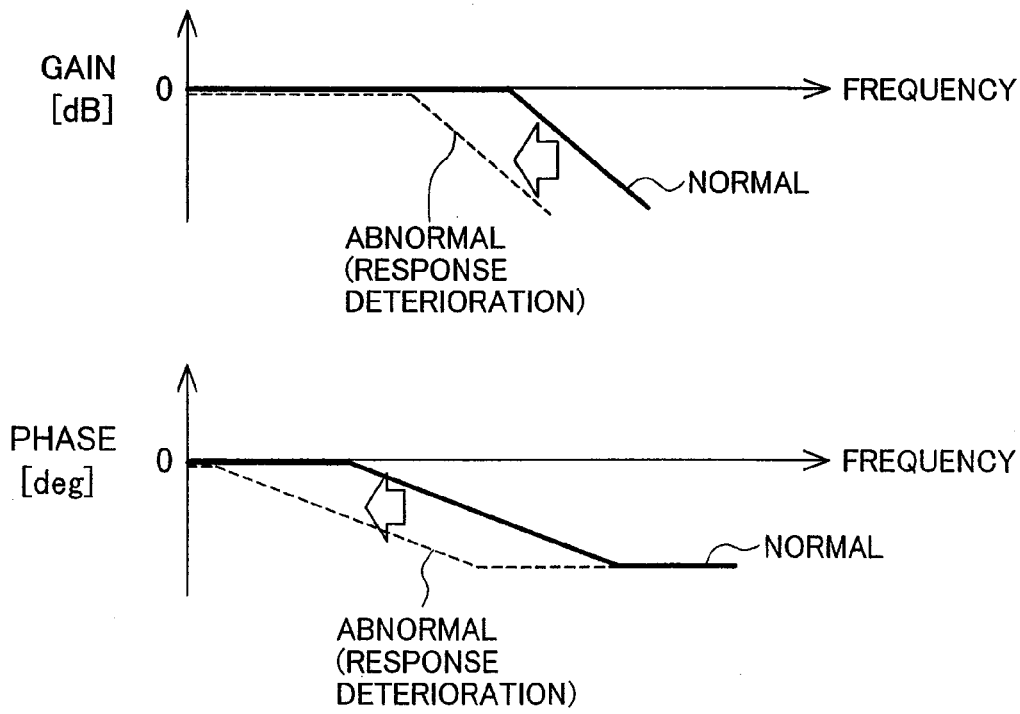
FIG. 22 is a set of graphs each showing a frequency response characteristic when the A/F sensor is normal and when a response characteristic of the A/F sensor is changed.
Figure 23:
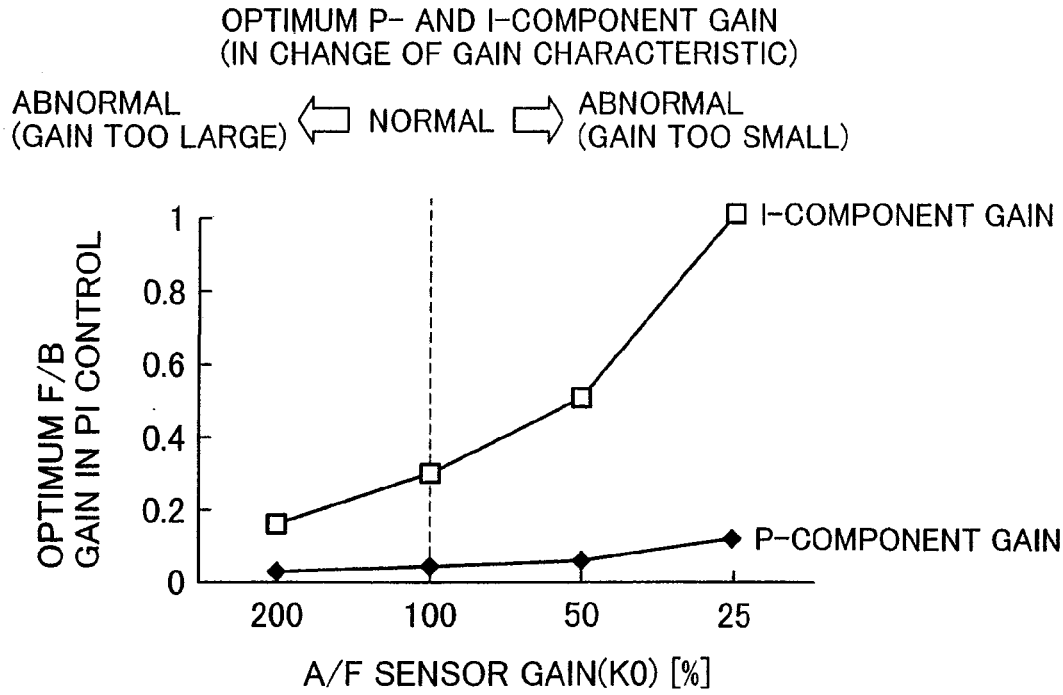
FIG. 23 is a graph showing optimum P- and I-component gains in PI control when the A/F sensor is normal and when the gain characteristic of the A/F sensor is changed.
Figure 24:
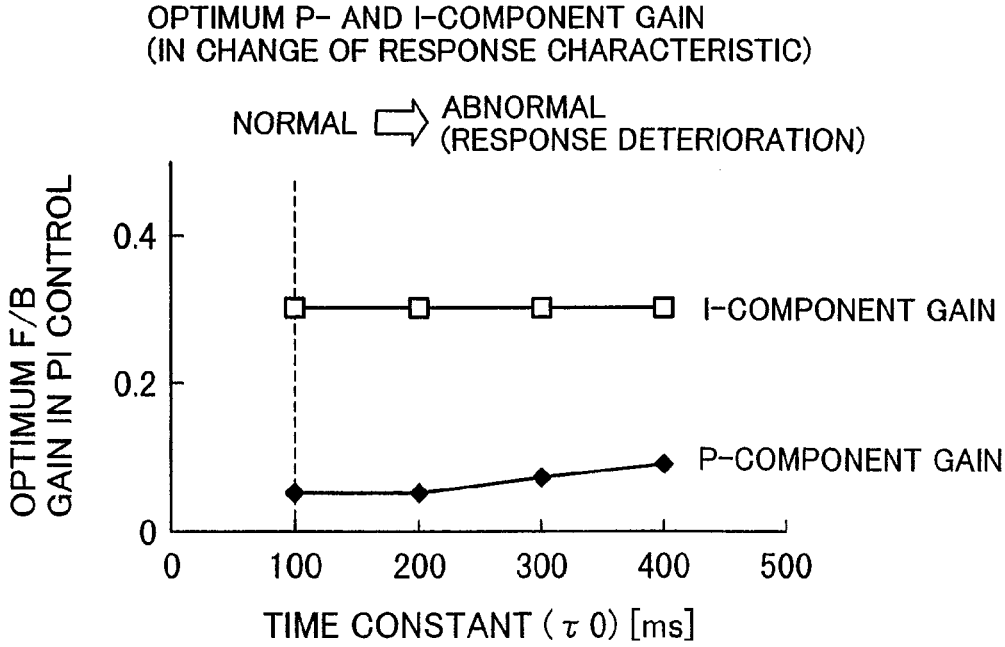
FIG. 24 is a graph showing optimum P- and I-component gains in PI control when the A/F sensor is normal and when the response characteristic of the A/F sensor is changed.
Figure 40:
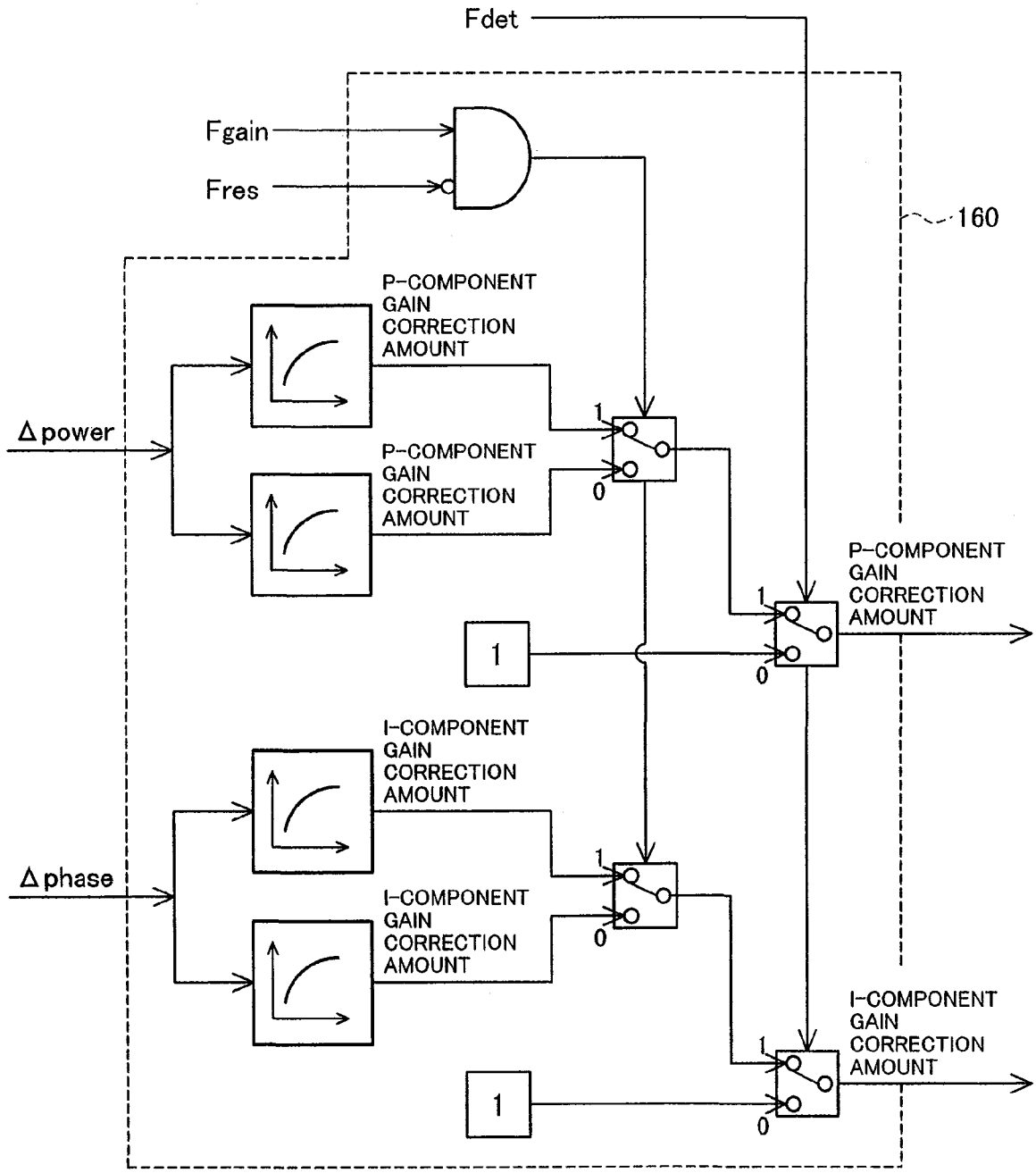
FIG. 40 is a block diagram for explaining an A/F-ratio F/B-control parameter correction amount computing unit in the fourth embodiment.

This computing unit 160 computes optimum P- and I-component gain correction amounts depending on the diagnosis result of the A/F sensor diagnosis unit 150, i.e., the characteristic change (deterioration degree) of the A/F sensor 52. In practice, as shown in FIG. 40, in the case of Fdet=1 indicating that the characteristic of the A/F sensor 52 has changed a predetermined amount, the optimum P- and I-component gain correction amounts are computed. More specifically, when the gain characteristic of the A/F sensor 52 has changed (i.e., Fgain=1), the P-component gain correction amount is computed based on Δpower, and the I-component gain correction amount is computed based on Δphase. Also, when the response characteristic of the A/F sensor 52 has changed (i.e., Fres=1), the P-component gain correction amount is computed based on Δpower, and the I-component gain correction amount is computed based on Δphase. Because the optimum P- and I-component gains differ between when the gain characteristic of the A/F sensor 52 has changed and the response characteristic thereof has changed, respective optimum parameters are set separately. The optimum parameters are decided in advance based on results of simulations or experiments, by way of example, as shown in FIGS. 23 and 24. When the characteristic of the A/F sensor 52 is normal, i.e., in the case of Fdet=0, the P-component gain correction amount and the I-component gain correction amount are each set to 1. Namely, no correction is made on the P- and I-component gains that have been set by the A/F-ratio F/B correction amount computing unit 123.

Figure 41A:
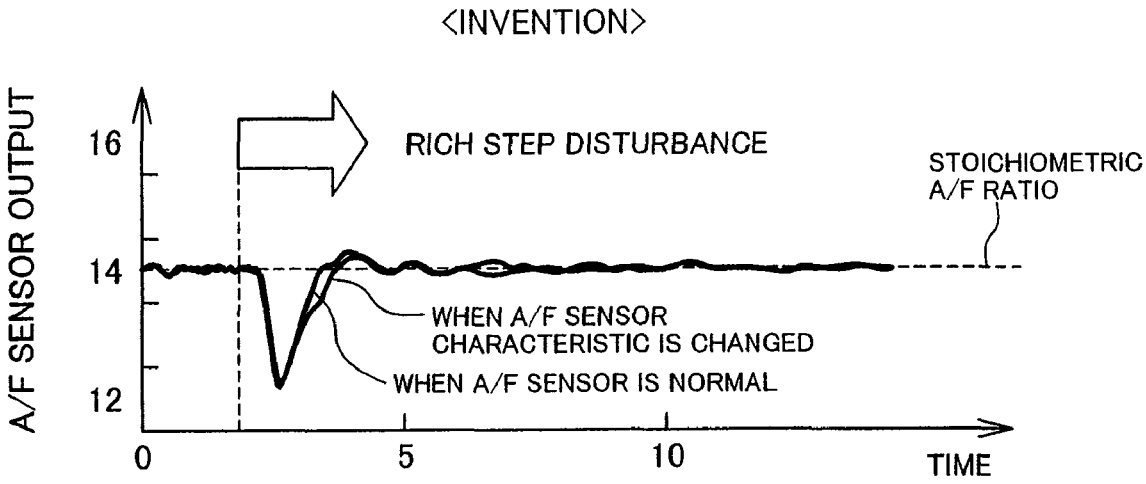
FIGS. 41A and 41B are graphs showing comparative test results of A/F sensor output between the fourth embodiment of the present invention and the prior art.
Figure 41B:
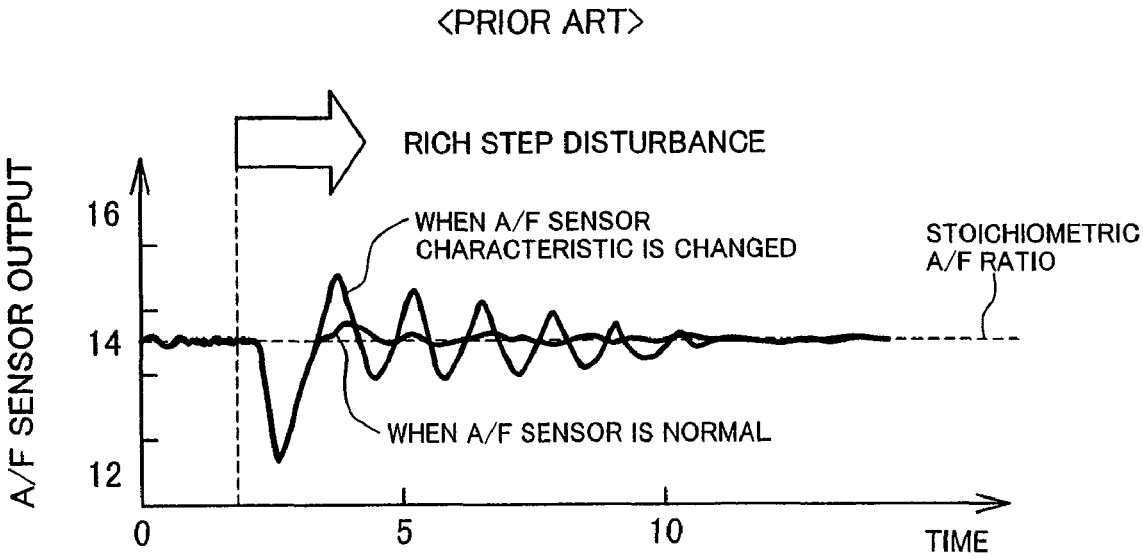

FIGS. 41A and 41B show comparative test results of the A/F sensor output between the present invention (fourth embodiment) and the prior art (without adaptive PI control depending on a characteristic change of the A/F sensor). More specifically, the test was conducted by evaluating a disturbance response when a rich A/F ratio disturbance was applied in a steady state. As seen from FIGS. 41A and 41B, with this embodiment, even when the characteristic of the A/F sensor 52 changes (deteriorates), the performance is hardly deteriorated because the P- and I-component gains in the PI control are optimized correspondingly. In the prior art, however, because of including no adaptive control for the performance change of the A/F sensor, the disturbance response deteriorates with the characteristic change of the A/F sensor.

Fifth Embodiment

Figure 42:
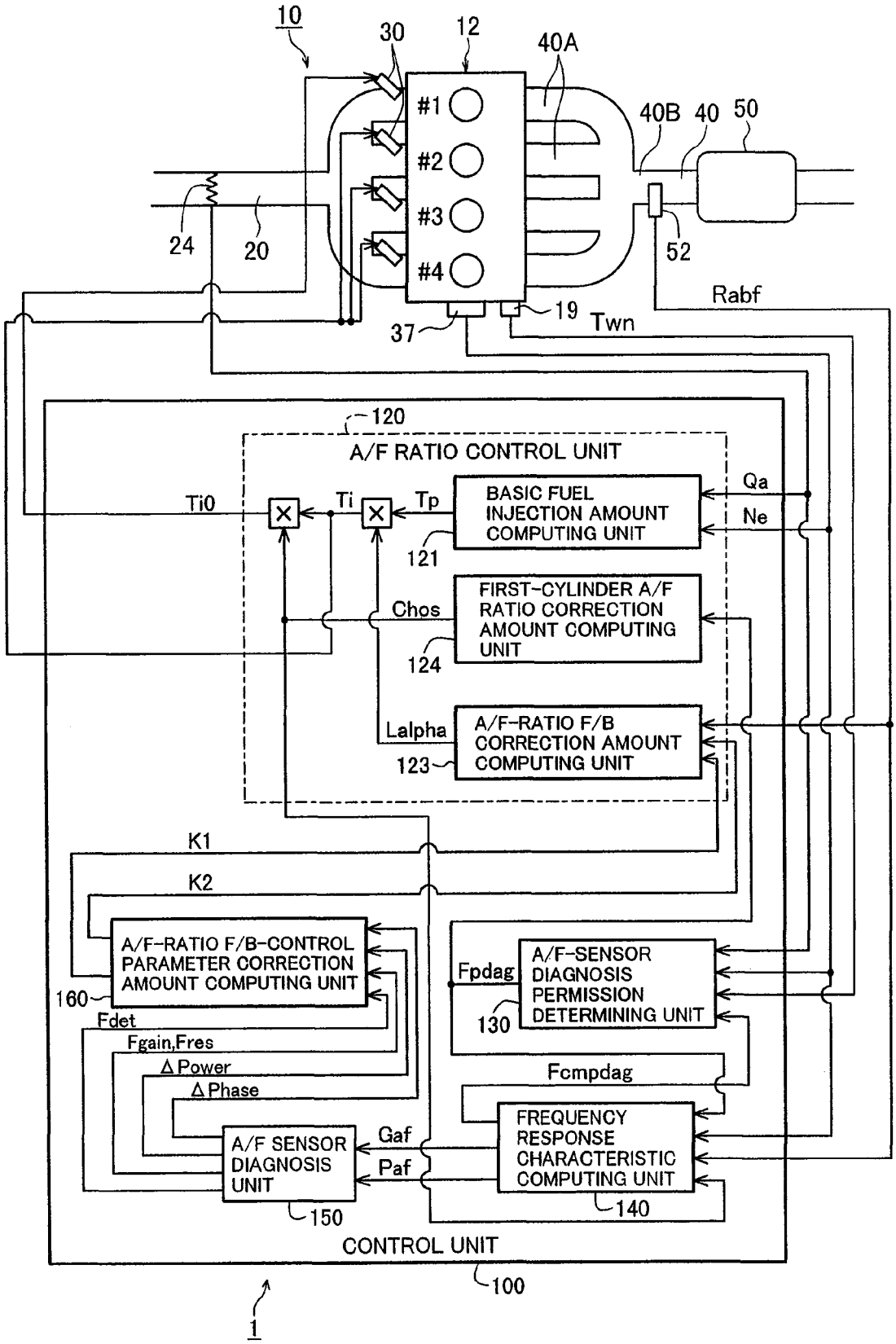
FIG. 42 is a block diagram of a control system in the fifth embodiment.

A fifth embodiment of the engine controller according to the present invention will be described below. Various components of the fifth embodiment are of substantially the same configurations as those of the above-described fourth embodiment (FIG. 38) except for the processing procedures executed by the A/F-ratio F/B correction amount computing unit 123 and the A/F-ratio F/B-control parameter correction amount computing unit 160 (see FIG. 42). The following description is made primarily of different points from the fourth embodiment.

While, in the above-described fourth embodiment, the A/F-ratio F/B-control parameter correction amount computing unit 160 computes the respective correction amounts for the P-component gain and the I-component gain which are parameters in the A/F ratio feedback control (PI control), this fifth embodiment is modified so as to compute correction amounts K1, K2 which are applied to the signal (output value) obtained from the A/F sensor 52. The correction amounts K1, K2 are sent to the A/F-ratio F/B correction amount computing unit 123 for use in correcting the output of the A/F sensor 52, and are optimized depending on the characteristic change of the A/F sensor 52. The remaining is the same as that in the fourth embodiment. The following description is made primarily of different points from the fourth embodiment.

<A/F-Ratio F/B Correction Amount Computing Unit 123>

Figure 43:
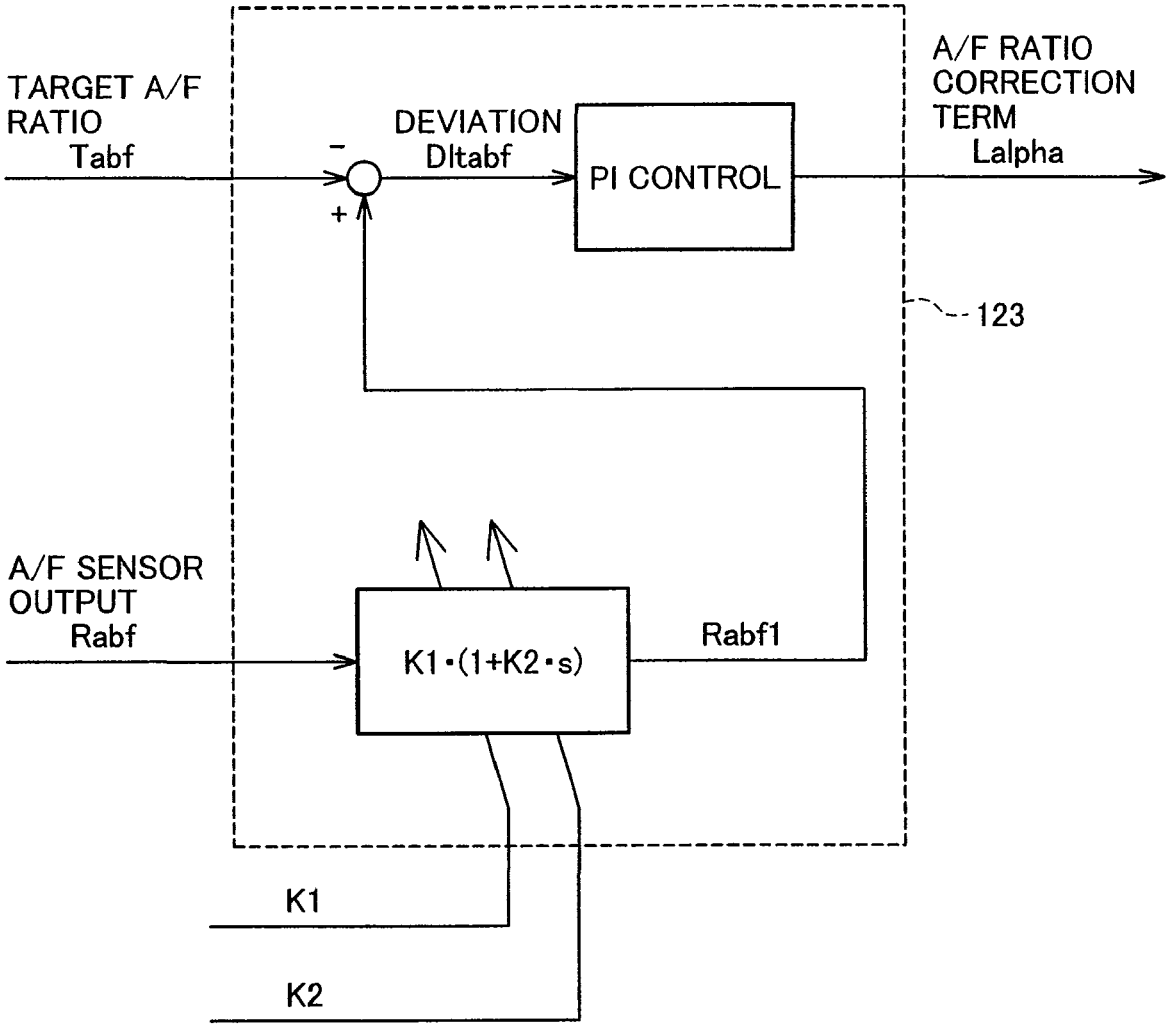
FIG. 43 is a block diagram for explaining an A/F-ratio F/B correction amount computing unit in the fifth embodiment.

In the A/F ratio control unit 120 of this fourth embodiment, A/F ratio feedback control (PI control) is executed based on the A/F ratio detected by the A/F sensor 52 so that an average A/F ratio in the exhaust joining portion 40B (i.e., at an inlet of the three-way catalyst 50) is equal to the target A/F ratio in the operating status under arbitrary conditions. In practice, as shown in FIG. 43, the A/F-ratio F/B correction amount computing unit 123 computes an A/F ratio correction term Lalpha from a deviation Dltabf between a target A/F ratio Tabf and a real A/F ratio Rabf detected by the A/F sensor 52. The A/F ratio correction term Lalpha is multiplied by the basic fuel injection amount Tp. Further, the output of the A/F sensor 52 is corrected depending on a characteristic change (deterioration degree) of the A/F sensor 52 by using the correction amounts K1, K2 which are computed by the A/F-ratio F/B-control parameter correction amount computing unit 160 (described later). Stated in more detail, when the gain of the A/F sensor 52 deteriorates, K1 is used to perform reverse compensation so as to maintain the gain at a level similar to that in the normal state. When the response of the A/F sensor 52 deteriorates, K2 is used to perform phase advance compensation so as to maintain the response at a level similar to that in the normal state.

<A/F-Ratio F/B-Control Parameter Correction Amount Computing Unit 160>

Figure 44:
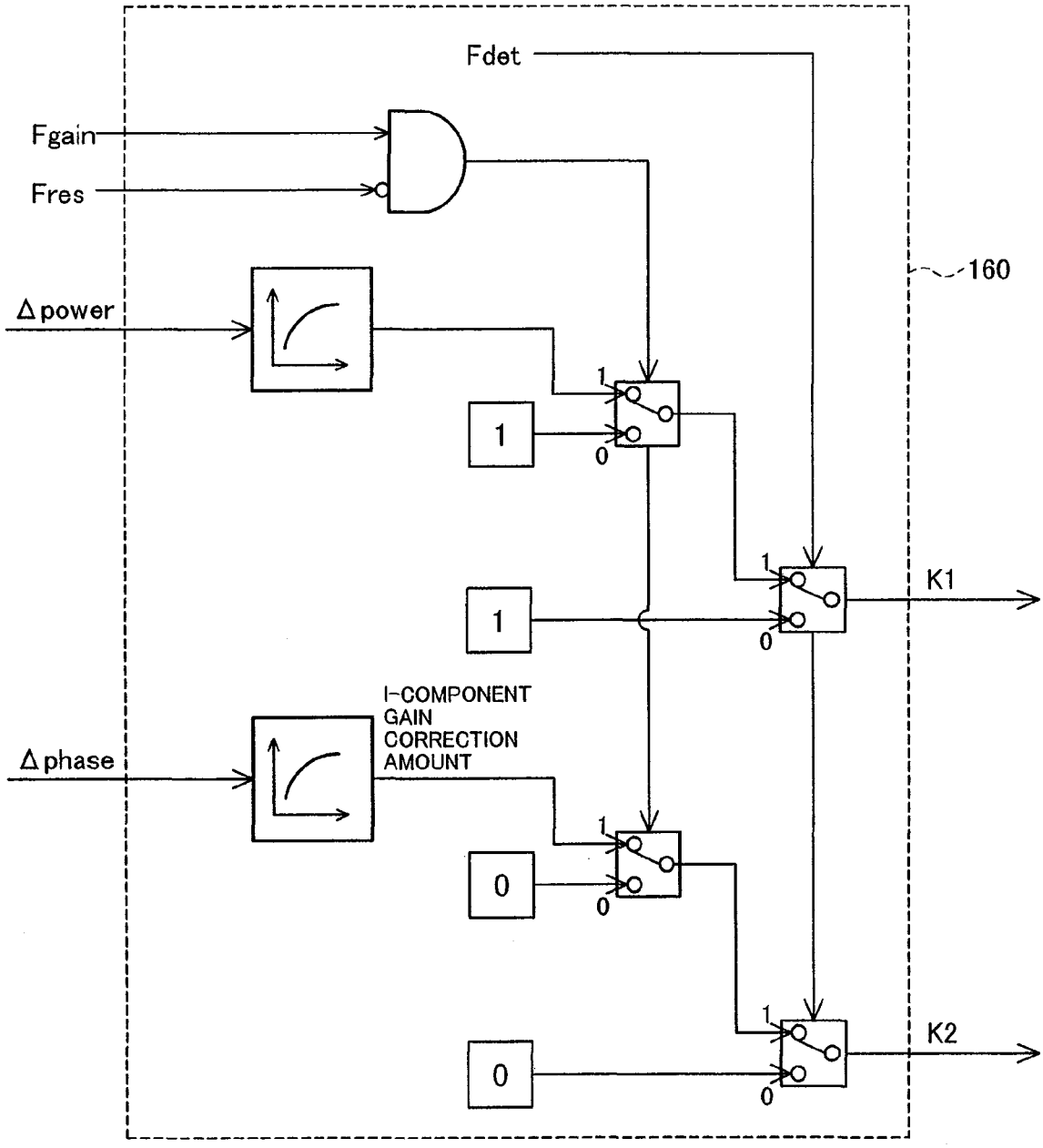
FIG. 44 is a block diagram for explaining an A/F-ratio F/B-control parameter correction amount computing unit in the fifth embodiment.

This computing unit 160 computes the parameters (correction amounts) K1, K2 used in the A/F-ratio F/B correction amount computing unit 123 depending on the diagnosis result of the A/F sensor diagnosis unit 150, i.e., the characteristic change (deterioration degree) of the A/F sensor 52. In practice, as shown in FIG. 44, in the case of Fdet=1 indicating that the characteristic of the A/F sensor 52 has changed a predetermined amount, optimum values of K1, K2 are computed. More specifically, when the gain characteristic of the A/F sensor 52 has changed (i.e., Fgain=1), K1 is computed based on Δpower. Also, when the response characteristic of the A/F sensor 52 has changed (i.e., Fres=1), K2 is computed based on Δphase. Note that respective optimum parameters are decided in advance based on results of simulations or experiments. When the characteristic of the A/F sensor 52 is normal, i.e., in the case of Fdet=0, K1=1 and K2=0 are set. Namely, no correction is made on the output of the A/F sensor 52, and the output of the A/F sensor 52 is directly used as an input value for the PI control.

Sixth Embodiment

Figure 45:
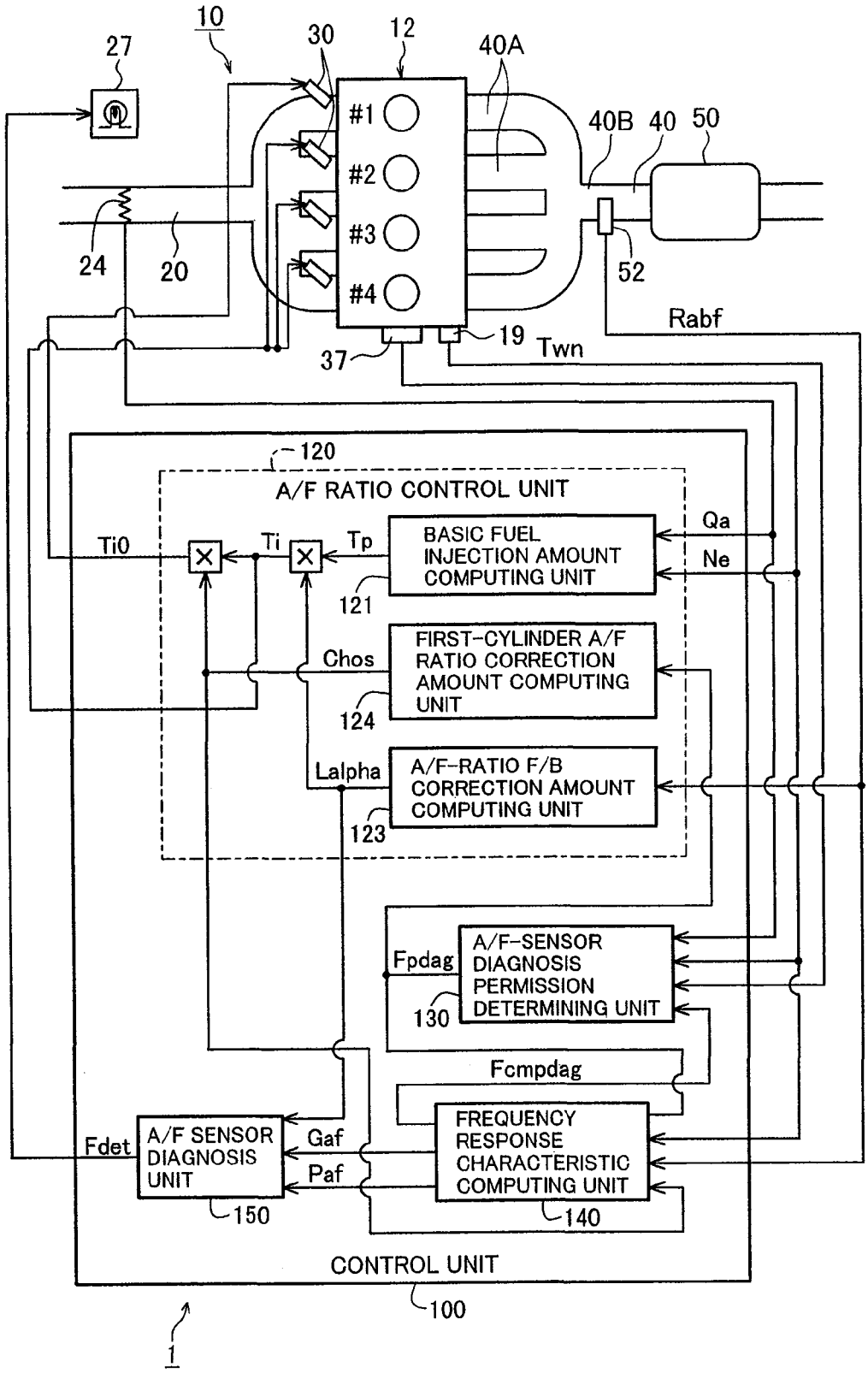
FIG. 45 is a block diagram of a control system in the sixth embodiment.

A sixth embodiment of the engine controller according to the present invention will be described below. Various components of the sixth embodiment are of substantially the same configurations as those of the above-described second embodiment (FIG. 34) except for the processing procedure executed by the A/F sensor diagnosis unit 150 (see FIG. 45). The following description is made primarily of different points from the second embodiment.

<A/F Sensor Diagnosis Unit 150>

Figure 46:
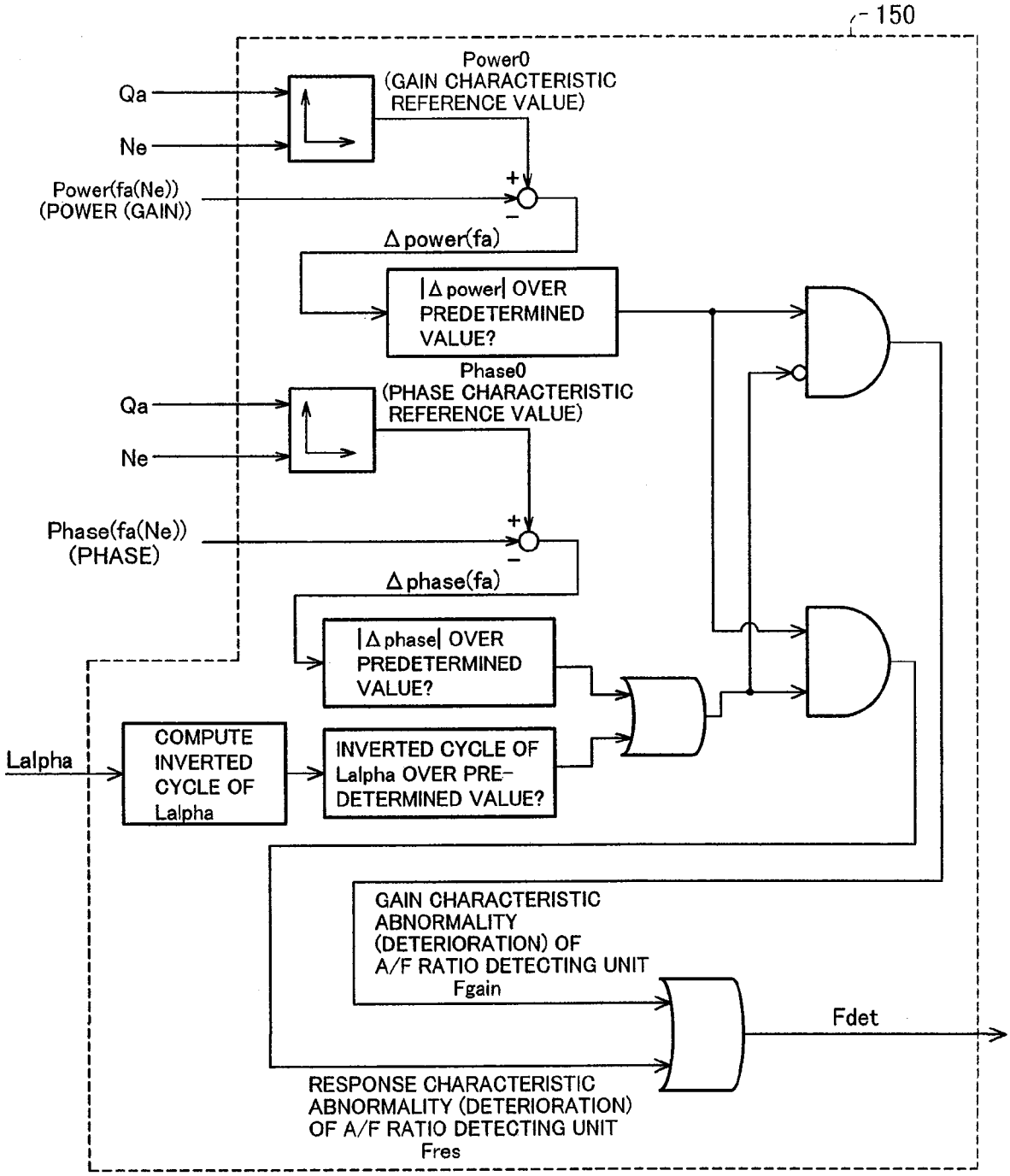
FIG. 46 is a block diagram for explaining an A/F sensor performance determining unit in the sixth embodiment.

The A/F sensor diagnosis unit 150 in this third embodiment diagnoses the A/F sensor 52 by using not only Power(fa(Ne)) and Phase(fa(Ne)) both computed by the frequency response characteristic computing unit 140, but also Lalpha computed by the A/F-ratio F/B correction amount computing unit 123. In practice, as shown in FIG. 46, the diagnosis unit 150 computes the difference Δpower(fa) between the gain characteristic Power(fa(Ne)) and the gain characteristic reference value Power0. The gain characteristic reference value Power0 is decided in advance, for example, on the basis of a gain characteristic that is obtained under the operating status at a certain air intake Qa and a certain engine RPM Ne (including the value of Kchos) in the normal state of the A/F sensor 52. Also, the diagnosis unit 150 computes the difference Δphase (fa) between the phase characteristic Phase(fa(Ne)) and the phase characteristic reference value Phase0. The phase characteristic reference value Phase0 is decided in advance, for example, on the basis of a phase characteristic that is obtained under the operating status at a certain air intake Qa and a certain engine RPM Ne (including the value of Kchos) in the normal state of the A/F sensor 52. The phase is given as, e.g., a phase relative to the TDC (Top Dead Center) of the engine or the timing of the so-called cylinder determination signal.

The diagnosis unit 150 determines that the gain characteristic of the A/F sensor 52 has changed, when the absolute value of Δpower is over a predetermined value and the absolute value of Δphase is below a predetermined value, i.e., when only the gain characteristic is changed. On the other hand, the diagnosis unit 150 determines that the response characteristic of the A/F sensor 52 has changed, when the absolute value of Δpower is over the predetermined value, the absolute value of Δphase is over the predetermined value, and the inverted cycle of Lalpha is over a predetermined value. Herein, the inverted cycle of Lalpha is given as a total of a time during which Lalpha indicates a value representing the rich correction and a time during which Lalpha indicates a value representing the lean correction. In other words, this sixth embodiment is intended to increase the accuracy in detecting the response characteristic of the A/F sensor, taking into consideration that the time during which the value of Lalpha computed in the A/F ratio feedback control using the A/F sensor 52 represents either the rich correction or the lean correction is prolonged as the response of the A/F sensor 52 becomes even worse.

Further, when any of the gain characteristic and the response characteristic of the A/F sensor 52 has changed, the deterioration indicator lamp 27 is lit up (Fdet=1), for example, to inform the driver of the deterioration of the A/F sensor 52. It is desired that the predetermined values mentioned above be empirically decided depending on not only the characteristics of the engine and the catalyst, but also the target diagnosis performance.

Seventh Embodiment

Figure 47:
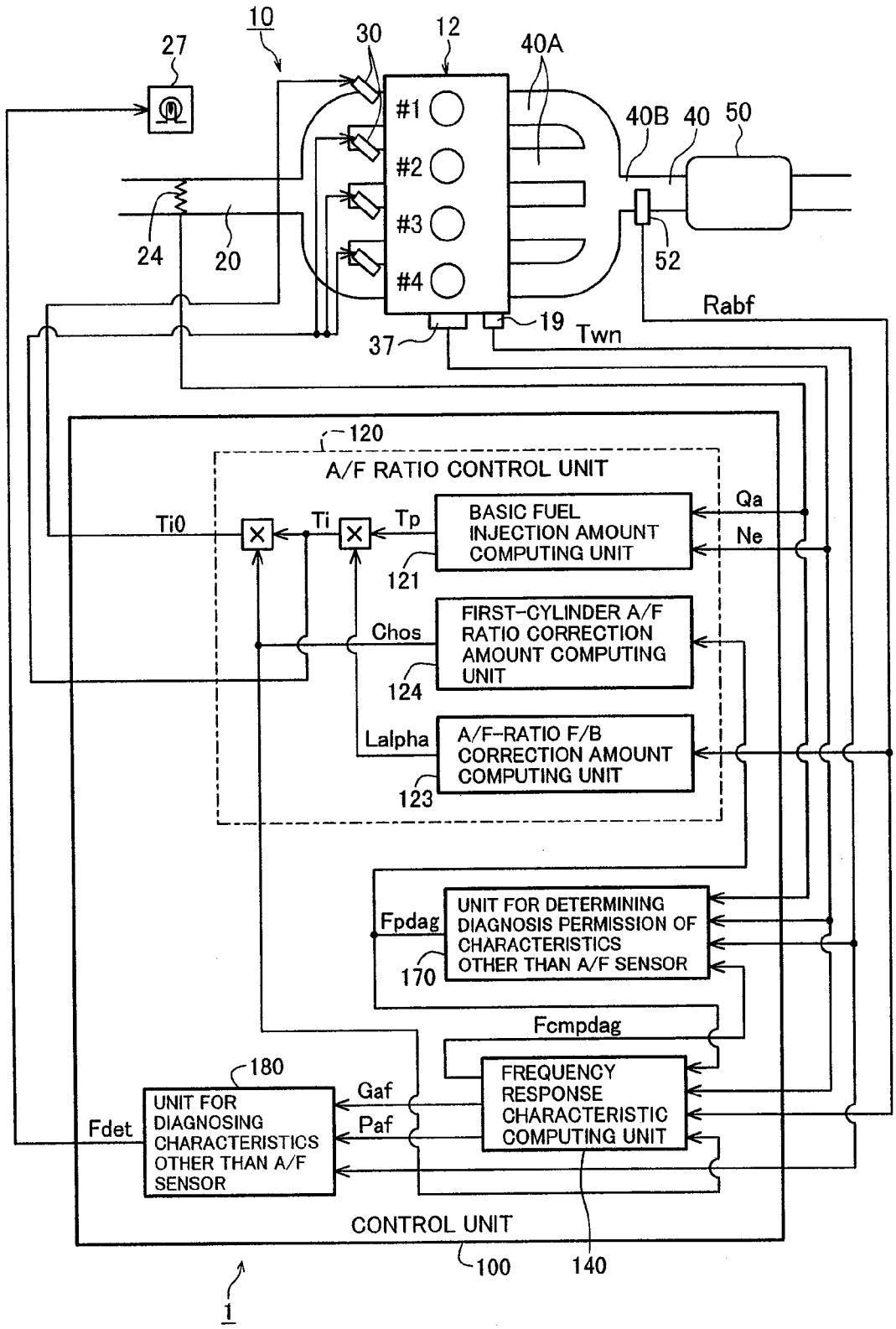
FIG. 47 is a block diagram of a control system in the seventh embodiment.

A seventh embodiment of the engine controller according to the present invention will be described below. The seventh embodiment duffers from the above-described second embodiment (FIG. 34) in having the function of diagnosing, in addition to the A/F sensor 52, the characteristic other than the A/F sensor 52. For that purpose, a unit 170 for determining diagnosis permission of characteristics other than the A/F sensor is disposed in place of the A/F-sensor diagnosis permission determining unit 130 in the second embodiment, and a unit 180 for diagnosing characteristic other than the A/F sensor is disposed in place of the A/F sensor diagnosis unit 150 (see FIG. 47). The following description is made primarily of different points from the second embodiment.

<Unit 170 for Determining Diagnosis Permission of Characteristics Other than the A/F Sensor, Unit 180 for Diagnosing Characteristic Other than the A/F Sensor>

Figure 48:
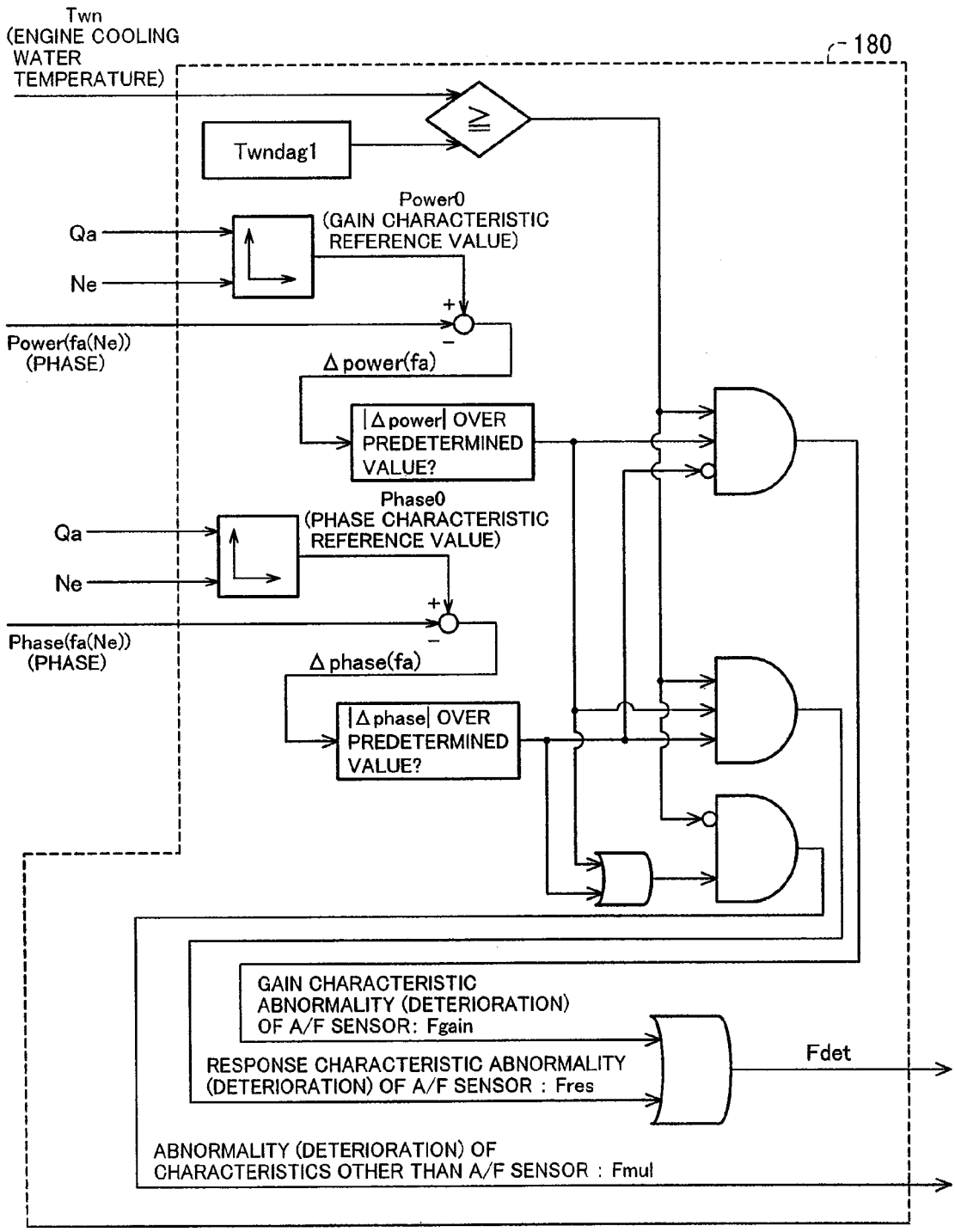
FIG. 48 is a block diagram for explaining a unit for diagnosing other units than the A/F sensor in the seventh embodiment.

In this seventh embodiment, the A/F sensor 52 and characteristics other than the A/F sensor 52 are diagnosed by using Power(fa(Ne)) and Phase(fa(Ne)) both computed by the frequency response characteristic computing unit 140, as well as the water temperature Twn. Herein, fuel nature is detected (diagnosed) as one example of the characteristics to be diagnosed other than the A/F sensor. In practice, as shown in FIG. 48, the diagnosis unit 150 computes the difference Δpower (fa) between the gain characteristic Power(fa(Ne)) and the gain characteristic reference value Power0. The gain characteristic reference value Power0 is decided in advance, for example, on the basis of a gain characteristic that is obtained under the operating status at a certain air intake Qa and a certain engine RPM Ne (including the value of Kchos) in the normal state of the A/F sensor 52. Also, the diagnosis unit 150 computes the difference Δphase(fa) between the phase characteristic Phase(fa(Ne)) and the phase characteristic reference value Phase0. The phase characteristic reference value Phase0 is decided in advance, for example, on the basis of a phase characteristic that is obtained under the operating status at a certain air intake Qa and a certain engine RPM Ne (including the value of Kchos) in the normal state of the A/F sensor 52. The phase is given as, e.g., a phase relative to the TDC (Top Dead Center) of the engine or the timing of the so-called cylinder determination signal.

Then, on condition of the water temperature Twn being over a predetermined value, the diagnosis unit 180 determines that the gain characteristic of the A/F sensor 52 has changed, when the absolute value of Δpower is over a predetermined value and the absolute value of Δphase is below a predetermined value, i.e., when only the gain characteristic is changed. On the other hand, the diagnosis unit 180 determines that the response characteristic of the A/F sensor 52 has changed, when the absolute value of Δpower is over the predetermined value and the absolute value of Δphase is over the predetermined value.

Additionally, on condition of the water temperature Twn being below a predetermined value, the diagnosis unit 180 determines that a device or a characteristic other than the A/F sensor 52 is abnormal, when the absolute value of Δpower is over the predetermined value and the absolute value of Δphase is over the predetermined value. In this embodiment, particularly, it is determined that the fuel nature has changed. To describe in more detail, if the fuel nature changes, an evaporation rate of the injected fuel also changes. Therefore, the fuel transfer characteristic from the fuel injector valve 30 to the A/F sensor 52 varies in spite of no change in the characteristic of the A/F sensor 52. However, because a change of the fuel nature is generally caused only in a low temperature state, the determination as to the fuel nature is performed when the water temperature Twn is below Twndag1.

Further, when any of the gain characteristic and the response characteristic of the A/F sensor 52 has changed, the deterioration indicator lamp 27 is lit up (Fdet=1), for example, to inform the driver of the deterioration of the A/F sensor 52. It is desired that the predetermined values mentioned above be empirically decided depending on not only the characteristics of the engine and the catalyst, but also the target diagnosis performance.

What is claimed is:

1. An engine controller for controlling an air/fuel ratio, comprising:

a frequency response characteristic apparatus configured to compute, based on an air/fuel ratio detected by air/fuel ratio detecting means and an air/fuel ratio control signal outputted to air/fuel ratio adjusting means, a gain characteristic as a frequency response characteristic in a range from said air/fuel ratio adjusting means to said air/fuel ratio detecting means, and having gain computing means for computing gain characteristics for at least two frequencies; and separate computing means for computing a change of said gain characteristic and a change of a response characteristics of said air/fuel ratio detecting means based on said gain characteristics for at least two frequencies computed by said gain computing means.

2. An engine controller according to claim 1, wherein said at least two frequencies are a direct current component, a frequency of which is 0 Hz, and an alternating current component, a frequency of which is not 0 Hz.

3. An engine controller according to claim 1, wherein said at least two frequencies are a frequency which is lower than a predetermined frequency and another frequency which is higher than said predetermined frequency.

4. An engine controller according to claim 3, wherein said predetermined frequency is a cutoff frequency of said gain characteristic of said frequency response characteristic in a range from said air/fuel ratio adjusting means to said air/fuel ratio detecting means is higher than a predetermined value.

5. An engine controller according to claim 3, wherein said predetermined frequency is a cutoff frequency of said gain characteristic of said frequency response characteristic in a range from said air/fuel ratio adjusting means to said air/fuel ratio detecting means is higher than a predetermined value.

6. An engine controller according to claim 1, further comprising:

correction means for correcting said air/fuel ratio control signal outputted to air/fuel ratio adjusting means based on said change of said gain characteristic or said change of a response characteristic of said air/fuel ratio detecting means computed by said separate computing means.

7. An engine controller according to claim 1, further comprising:

informing means for informing a driver when an amount of said change of said gain characteristic or said change of a frequency response characteristic of said air/fuel ratio detecting means computed by said separate computing means is higher than a predetermined value.

* * * * *